US006814776B2

(12) United States Patent
Kanekiyo et al.

(10) Patent No.: US 6,814,776 B2
(45) Date of Patent: Nov. 9, 2004

(54) IRON BASE RARE EARTH ALLOY POWDER AND COMPOUND COMPRISING IRON BASE RARE EARTH ALLOY POWDER AND PERMANENT MAGNET USING THE SAME

(75) Inventors: Hirokazu Kanekiyo, Kyoto (JP); Hirokazu Kitayama, Osaka (JP); Satoshi Hirosawa, Otsu (JP); Toshio Miyoshi, Osaka (JP)

(73) Assignee: Neomax Co., Ltd., Osaka (JP)

( * ) Notice: Subject to any disclaimer, the term of this patent is extended or adjusted under 35 U.S.C. 154(b) by 0 days.

(21) Appl. No.: 10/470,547

(22) PCT Filed: Feb. 6, 2002

(86) PCT No.: PCT/JP02/00993

§ 371 (c)(1),
(2), (4) Date: Jul. 30, 2003

(87) PCT Pub. No.: WO02/062510

PCT Pub. Date: Aug. 15, 2002

(65) Prior Publication Data

US 2004/0079449 A1 Apr. 29, 2004

(30) Foreign Application Priority Data

| | | |
|---|---|---|
| Feb. 7, 2001 | (JP) | 2001-030593 |
| May 30, 2001 | (JP) | 2001-163023 |
| Nov. 22, 2001 | (JP) | 2001-357916 |

(51) Int. Cl.[7] ..... C22C 33/02; H01F 1/057

(52) U.S. Cl. ..... 75/244; 75/246; 148/101; 148/302; 419/65; 419/66

(58) Field of Search ..... 75/244, 255; 148/101, 148/302; 419/65, 66

(56) References Cited

U.S. PATENT DOCUMENTS

| | | | | |
|---|---|---|---|---|
| 4,836,868 A | | 6/1989 | Yajima et al. | |
| 5,049,203 A | * | 9/1991 | Mukai et al. | 148/101 |
| 5,595,608 A | * | 1/1997 | Takebuchi et al. | 148/104 |
| 5,834,663 A | * | 11/1998 | Fukuno et al. | 75/244 |
| 5,872,501 A | * | 2/1999 | Hamano et al. | 252/62.54 |
| 6,648,984 B2 | * | 11/2003 | Takaki et al. | 148/101 |

FOREIGN PATENT DOCUMENTS

| | | |
|---|---|---|
| EP | 0632471 A2 | 1/1995 |
| JP | 1-162702 A | 6/1989 |
| JP | 1-204401 A | 8/1989 |
| JP | 4-147604 A | 5/1992 |
| JP | 05-315174 | 11/1993 |
| JP | 08-124730 | 5/1996 |
| JP | 11-206075 | 7/1999 |
| JP | 2002-302702 | 10/2002 |

OTHER PUBLICATIONS

Chang et al., "The Effects of Refractory Metals on the Magnetic Properties of $\alpha$–Fe/$R_2Fe_{14}B$–Type Nanocomposites" IEEE Transactions on Magnetics, vol. 35, No. 5, Sep. 1999, pp. 3265–3267.

* cited by examiner

*Primary Examiner*—Ngoclan T. Mai
(74) *Attorney, Agent, or Firm*—Keating & Bennett, LLP.

(57) ABSTRACT

An iron-based rare-earth alloy powder includes: a first iron-based rare-earth alloy powder, which has a mean particle size of 10 $\mu$m to 70 $\mu$m and of which the powder particles have aspect ratios of 0.4 to 1.0; and a second iron-based rare-earth alloy powder, which has a mean particle size of 70 $\mu$m to 300 $\mu$m and of which the powder particles have aspect ratios of less than 0.3. The first and second iron-based rare-earth alloy powders are mixed at a volume ratio of 1:49 to 4:1. In this manner, an iron-based rare-earth alloy powder with increased flowability and a compound to make a magnet are provided.

26 Claims, 11 Drawing Sheets

IRON BASE RARE EARTH ALLOY POWDER AND COMPOUND COMPRISING IRON BASE RARE EARTH ALLOY POWDER AND PERMANENT MAGNET USING THE SAME

BACKGROUND OF THE INVENTION

1. Field of the Invention

The present invention relates to an iron-based rare-earth alloy powder, which can be used effectively as a material for a bonded magnet, and a method of making the alloy powder. The present invention also relates to a bonded magnet made from the rare-earth alloy powder and further relates to various types of electric equipment including the bonded magnet.

2. Description of the Related Art

A bonded magnet is currently used in various types of electric equipment including motors, actuators, loudspeakers, meters and focus convergence rings. A bonded magnet is a magnet obtained by mixing together a magnet powder and a binder (such as a rubber or a resin) and then compacting and setting the mixture.

An iron-based rare-earth alloy (e.g., Fe-R-B based, in particular) nanocomposite magnet has recently been used more and more often as a magnet powder for a bonded magnet because such a magnet powder is relatively cost effective. The Fe-R-B based nanocomposite magnet is an iron-based alloy permanent magnet in which nanometer-scale crystals of iron-based borides (e.g., $Fe_3B$, $Fe_{23}B_6$ and other soft magnetic phases) and those of an $R_2Fe_{14}B$ phase as a hard magnetic phase are distributed uniformly within the same metal structure and are magnetically coupled together via exchange interactions.

The nanocomposite magnet includes soft magnetic phases and yet exhibits excellent magnet performance due to the magnetic coupling between the soft and hard magnetic phases. Also, since there are those soft magnetic phases including no rare-earth elements R such as Nd, the total percentage of the rare-earth elements R can be relatively low. This is advantageous for the purposes of reducing the manufacturing cost of magnets and supplying the magnets constantly. Furthermore, since the magnet includes no R-rich phases in the grain boundary, the magnet also excels in anticorrosiveness.

Such a nanocomposite magnet is obtained by solidifying a molten material alloy (i.e., "molten alloy") by a rapid cooling process and then subjecting the rapidly solidified alloy to an appropriate heat treatment process. A single roller method is often used to rapidly cool the molten alloy. The single roller method is a method of cooling and solidifying a molten alloy by bringing the alloy into contact with a rotating chill roller. In this method, the resultant rapidly solidified alloy has the shape of a thin strip (or ribbon), which is elongated in the peripheral velocity direction of the chill roller. This method of rapidly cooling a molten alloy by bringing the alloy into contact with the surface of a solid is called a "melt-quenching process".

On the other hand, in preparing a conventional extensively used powder for a bonded magnet, a rapidly solidified alloy thin strip with a thickness of 50 $\mu$m or less (typically about 20 $\mu$m to about 40 $\mu$m) is obtained at a roller surface peripheral velocity of 15 m/s or more The rapidly solidified alloy thin strip obtained in this manner is thermally treated and then pulverized to a mean particle size of 300 $\mu$m or less (typically about 150 $\mu$m) to be a rare-earth alloy powder for a permanent magnet. The particles of the rare-earth alloy powder obtained in this manner have a flat shape and have aspect ratios that are less than 0.3. As used herein, the "aspect ratio" means the ratio of the minor-axis size of a powder particle to the major-axis size thereof. The rare-earth alloy powder or magnet powder obtained by the melt-quenching process described above will be simply referred to herein as a "conventional rapidly solidified rare-earth alloy powder" or a "conventional rapidly solidified magnet powder". An Fe-R-B based MQ powder available from Magnequench International Inc. (which will be referred to herein as "MQI Inc.") is widely known as a typical conventional rapidly solidified magnet powder.

By mixing the conventional rapidly solidified rare-earth alloy powder with a resin (or rubber), a compound to make a magnet (which will be simply referred to herein as a "compound") is prepared. An additive such as a lubricant is sometimes mixed with this compound. Thereafter, by compacting the resultant compound into a desired shape by a compression, extrusion or injection molding process, for example, and then by magnetizing the compact, a bonded magnet is obtained as a compact for a permanent magnet (which will be sometimes referred to herein as a "permanent magnet body"). It should be noted that a rare-earth alloy powder to exhibit desired permanent magnet performance when magnetized or a magnetized rare-earth alloy powder will be sometimes referred to herein as a "permanent magnet powder" or simply "magnet powder (or magnetic powder".

The conventional rapidly solidified magnet powder has a flat particle shape as described above. Accordingly, a compound obtained by mixing the conventional rapidly solidified magnet powder with a resin (or rubber) powder exhibits poor flowability or packability during the compaction process thereof. To achieve flowability that is high enough to perform the compaction process smoothly, the percentage of the resin or rubber may be increased. In that case, however, the magnet powder percentage is limited. Or only limited compaction methods and/or compact shapes are available to compact such a material with poor flowability.

Recently, as various types of electric equipment have further reduced their sizes and further improved their performance, it has become more and more necessary to make magnets having an even smaller size and even higher performance. For that purpose, there is a growing demand for a compound that exhibits so high flowability as to fill even a small gap (e.g., with a width of about 2 mm) just as intended. For example, as in an IPM (interior permanent magnet) type motor including a magnet embedded rotor as disclosed in Japanese Laid-Open Publication No. 11-206075, a demand for a compound with high flowability goes on increasing.

Also, when the conventional rapidly solidified magnet powder is used, the magnet powder percentage (i.e., the ratio of the volume of magnet powder to that of overall bonded magnet) is at most about 80% when the powder is compacted by compression and at most about 65% when the powder is compacted by injection molding. The magnet powder percentage will determine the performance of permanent magnets as final products. Thus, to improve the performance of permanent magnets, the magnet powder percentage is preferably increased.

To increase the flowability of the conventional rapidly solidified magnet powder, Japanese Laid-Open Publication No. 5-315174 proposes a method in which a magnet powder obtained by a gas atomization process is used. According to this publication, the magnet powder prepared by the gas atomization process has almost granular particles. Thus, by adding this magnet powder to the conventional rapidly solidified magnet powder, the flowability can be increased. However, it is difficult to make a magnet powder exhibiting sufficient magnetic properties by a gas atomization process. Thus, this method is far from being an industrially applicable method. The reason is as follows. Specifically, the gas atomization process results in a lower cooling rate than the melt-quenching process described above. Accordingly, only very fine particles can satisfy the rapid cooling conditions that should be met to obtain particles with sufficient magnetic properties. Also, a melt of the rare-earth alloy having the composition disclosed in the publication identified above has a relatively high viscosity. Thus, it is hard to obtain fine particles. Consequently, according to the method disclosed in the publication identified above, the yield of those fine particles having sufficient magnetic properties is very low and the productivity is also very bad because a classification process step must be carried out to obtain particles with a desired particle size.

SUMMARY OF THE INVENTION

In order to overcome the problems described above, a primary object of the present invention is to provide a compound of which the flowability is improved by controlling the particle size distribution of an iron-based rare-earth alloy powder for use to make a bonded magnet, and provide such an iron-based rare-earth alloy powder.

Another object of the present invention is to provide a bonded magnet, which can exhibit excellent permanent magnet performance, by using the compound and by increasing the flowability and/or the magnet powder percentage, and an electric appliance including such a bonded magnet.

An iron-based rare-earth alloy powder according to the present invention includes: a first iron-based rare-earth alloy powder, which has a mean particle size of 10 $\mu$m to 70 $\mu$m and of which the powder particles have aspect ratios of 0.4 to 1.0; and a second iron-based rare-earth alloy powder, which has a mean particle size of 70 $\mu$m to 300 $\mu$m and of which the powder particles have aspect ratios of less than 0.3. The first and second iron-based rare-earth alloy powders are mixed at a volume ratio of 1:49 to 4:1, whereby the objects described above are achieved.

In a preferred embodiment, the first iron-based rare-earth alloy powder has a composition represented by the general formula: $(Fe_{1-m}T_m)_{100-x-y-z}Q_xR_yM_z$, where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb; and the mole fractions x, y, and z satisfy the inequalities of: 10 at %$\leqq$x$\leqq$30 at %; 2 at %$\leqq$y<10 at %; 0 at %$\leqq$z$\leqq$10 at %; and 0$\leqq$m$\leqq$0.5, respectively.

The first iron-based rare-earth alloy powder preferably includes, as its constituent phases, an Fe phase, an FeB compound phase and a compound phase having an $R_2Fe_{14}B$-type crystalline structure, and the respective constituent phases preferably have an average crystal grain size of 150 nm or less.

In another preferred embodiment, the first iron-based rare-earth alloy powder has a composition represented by the general formula: $(Fe_{1-m}T_m)_{100-x-y-z}Q_xR_yM_z$, where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb and always includes Ti; and the mole fractions x, y, z and m satisfy the inequalities of: 10 at %<x$\leqq$20 at %; 6 at %<y<10 at %; 0.1 at %:$\leqq$z$\leqq$12 at %; and 0$\leqq$m$\leqq$0.5, respectively. The percentage of Ti to the overall element M is preferably at least 60 at %, more preferably 80 at % or more.

The first iron-based rare-earth alloy powder preferably includes at least two ferromagnetic crystalline phases, of which hard magnetic phases preferably have an average crystal grain size of 5 nm to 200 nm and soft magnetic phases preferably have an average crystal grain size of 1 nm to 100 nm. More preferably, the average crystal grain size of the hard magnetic phases is greater than that of the soft magnetic phases.

The second iron-based rare-earth alloy powder preferably has a composition represented by the general formula: $(Fe_{100-x-y}Q_xR_y$, where Fe is iron; Q is at least one element selected from the group consisting of B and C and always includes B; R is at least one rare-earth element selected from the group consisting of Pr, Nd, Dy and Tb; and the mole fractions x and y satisfy the inequalities of 1 at %$\leqq$x$\leqq$6 at % and 10 at %$\leqq$y$\leqq$25 at %, respectively.

A method of making an iron-based rare-earth alloy powder according to the present invention includes the steps of: (a) providing a first iron-based rare-earth alloy powder, which has a mean particle size of 10 $\mu$m to 70 $\mu$m and of which the powder particles have aspect ratios of 0.4 to 1.0; (b) providing a second iron-based rare-earth alloy powder, which has a mean particle size of 70 $\mu$m to 300 $\mu$m and of which the powder particles have aspect ratios of less than 0.3; and (c) mixing the first and second iron-based rare-earth alloy powders at a volume ratio of 1:49 to 4:1, whereby the objects described above are achieved.

In a preferred embodiment, the first iron-based rare-earth alloy powder has a composition represented by the general formula: $(Fe_{1-m}T_m)_{100-x-y-z}Q_xR_yM_z$, where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb; and the mole fractions x, y, and z satisfy the inequalities of: 10 at %$\leqq$x$\leqq$30 at %; 2 at %$\leqq$y<10 at %; 0 at %$\leqq$z$\leqq$10 at %; and 0$\leqq$m$\leqq$0.5, respectively.

In another preferred embodiment, the first iron-based rare-earth alloy powder has a composition represented by the general formula: $(Fe_{1-m}T_m)_{100-x-y-z}Q_xR_yM_z$, where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb and always includes Ti; and the mole fractions x, y, z and m satisfy the inequalities of: 10 at %<x$\leqq$20 at %; 6 at %<y<10 at %; 0.1 at %$\leqq$z$\leqq$12 at %; and 0$\leqq$m$\leqq$0.5, respectively.

The step (a) preferably includes the steps of: cooling a melt of the first iron-based rare-earth alloy by a melt-quenching process, thereby forming a rapidly solidified alloy with a thickness of 70 μm to 300 μm; and pulverizing the rapidly solidified alloy.

The method may further include the step of thermally treating and crystallizing the rapidly solidified alloy before the step of pulverizing is performed.

The step of pulverizing is preferably carried out with a pin mill machine or a hammer mill machine.

The rapidly solidified alloy preferably includes at least one metastable phase, which is selected from the group consisting of $Fe_{23}B_6$, $Fe_3B$, $R_2Fe_{14}B$ and $R_2Fe_{23}B$ phases, and/or an amorphous phase.

The step of cooling preferably includes the step of bringing the melt into contact with a roller, which is rotating at a roller surface peripheral velocity of 1 m/s to 13 m/s, thereby forming the rapidly solidified alloy.

The step of cooling is preferably carried out within a reduced-pressure atmosphere.

The reduced-pressure atmosphere preferably has an absolute pressure of 1.3 kPa to 90 kPa.

The second iron-based rare-earth alloy powder preferably has a composition represented by the general formula: $(Fe_{100-x-y}Q_xR_y$, where Fe is iron; Q is at least one element selected from the group consisting of B and C and always includes B; R is at least one rare-earth element selected from the group consisting of Pr, Nd, Dy and Tb; and the mole fractions x and y satisfy the inequalities of 1 at %≦x≦6 at % and 10 at %≦y≦25 at %, respectively.

A compound for use to make a magnet according to the present invention includes the iron-based rare-earth alloy powder according to any of the preferred embodiments of the present invention described above and a resin, whereby the objects described above are achieved. The resin is preferably a thermoplastic resin.

A permanent magnet according to the present invention is made of the compound according to any of the preferred embodiments of the present invention described above. A permanent magnet having a density of at least 4.5 g/cm$^3$ can be obtained. Furthermore, a permanent magnet having a density of 5.5 g/cm$^3$ or more, or even 6.0 g/cm$^3$ or more, can also be obtained.

A method of making a compound for use to make a magnet according to the present invention includes the steps of: preparing the iron-based rare-earth alloy powder by the method according to any of the preferred embodiments of the present invention described above; and mixing the iron-based rare-earth alloy powder and a resin together.

The resin is preferably a thermoplastic resin.

A method for producing a permanent magnet according to the present invention preferably includes the step of injection-molding the compound made by the method described above.

A motor according to the present invention includes: a rotor including the permanent magnet according to any of the preferred embodiments of the present invention described above; and a stator, which is provided so as to surround the rotor.

A method for fabricating a motor according to the present invention includes the steps of: preparing a rotor, which has a magnet slot in its iron core; injection-molding the above-described compound for use to make a magnet in the magnet slot; and providing a stator that surrounds the rotor.

BRIEF DESCRIPTION OF THE DRAWINGS

FIG. 1(*b*) is a perspective view schematically illustrating a thin-strip alloy yet to be pulverized and pulverized powder particles for the prior art.

FIG. 2(*b*) is a partially enlarged view thereof.

DETAILED DESCRIPTION OF THE PREFERRED EMBODIMENTS

Figure 1A:
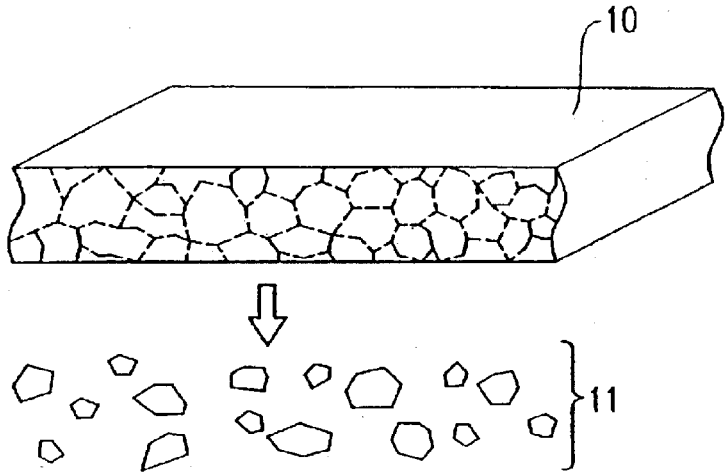
FIG. 1(*a*) is a perspective view schematically illustrating a thin-strip alloy yet to be pulverized and pulverized powder particles for the present invention.

An iron-based rare-earth alloy powder according to the present invention is obtained by mixing together a first iron-based rare-earth alloy powder, which has a mean particle size of 10 μm to 70 μm and of which the powder particles have aspect ratios of 0.4 to 1.0, and a second iron-based rare-earth alloy powder, which has a mean particle size of 70 μm to 300 μm and of which the powder particles have aspect ratios of less than 0.3, at a volume ratio of 1:49 to 4:1.

The particles of the first iron-based rare-earth alloy powder have aspect ratios of 0.4 to 1.0, and therefore have an isometric shape. Thus, the first iron-based rare-earth alloy powder has high flowability. Accordingly, when such an iron-based rare-earth alloy powder is mixed with the second iron-based rare-earth alloy powder, which is a conventional rapidly solidified rare-earth alloy powder, the resultant iron-based rare-earth alloy powder can have increased flowability. To strike an adequate balance between the flowability and the magnetic properties, the mixing ratio is preferably 1:49 to 4:1, more preferably 1:19 to 4:1, and even more preferably 1:9 to 4:1.

A rare-earth alloy powder obtained by the conventional melt-quenching process is preferably used as the second iron-based rare-earth alloy powder. Considering the magnetic properties to be achieved, an iron-based rare-earth alloy powder having a composition represented by the general formula: $(Fe_{100-x-y}B_xR_y$, where Fe is iron, B is boron or a mixture of boron and carbon, R is at least one rare-earth element selected from the group consisting of Pr, Nd, Dy and Tb, and the mole fractions x and y satisfy the inequalities of 1 at %≦x≦6 at % and 10 at %≦y≦25 at %, respectively, is particularly preferred. For example, the MQ powder produced by MQI Inc. may be used as the second iron-based rare-earth alloy powder.

Hereinafter, a method of making the first iron-based rare-earth alloy powder to be mixed with the second iron-based rare-earth alloy powder to increase the flowability thereof will be described.

First, a melt of the first iron-based rare-earth alloy is prepared. This melt is cooled by a melt-quenching process such as a melt spinning process or a strip casting process, thereby forming a rapidly solidified alloy with a thickness of 70 μm to 300 μm. Next, the rapidly solidified alloy is thermally treated and crystallized if necessary and then pulverized to obtain a powder, which has a mean particle size of 10 μm to 70 μm and of which the particles have aspect ratios (i.e., the ratio of the minor-axis size to the major-axis size) of 0.4 to 1.0. According to the present invention, at least 60 mass % of powder particles with particle sizes exceeding 10 μm can have aspect ratios of 0.4 to 1.0. It should be noted that the mean particle size is obtained herein from major-axis sizes.

First Iron-based Rare-earth Alloy (with no Ti)

An iron-based rare-earth alloy, having a composition represented by the general formula I: $(Fe_{1-m}T_m)_{100-x-y-z}Q_xR_yM_z$, where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb; and the mole fractions x, y, and z satisfy the inequalities of: 10 at %≦x≦30 at %; 2 at %≦y<10 at %; 0 at %≦z≦10 at %; and 0≦m≦0.5, respectively, is preferably used as the first iron-based rare-earth alloy. It should be noted that an iron-based rare-earth alloy, including at least 0.5 at % of Ti as the element M in the general formula I, will be referred to herein as a "Ti-containing first iron-based rare-earth alloy" and will be described in detail later because Ti achieves unique functions and effects.

In a preferred embodiment, a molten alloy having a composition represented by the general formula I is cooled by a melt-quenching process to form a rapidly solidified alloy including amorphous phases. Then, the rapidly solidified alloy is heated, thereby forming nanometer-scale crystals in the constituent phases. To obtain a uniform structure, the rapid cooling process is preferably carried out within a reduced-pressure atmosphere. In a preferred embodiment, the molten alloy is brought into contact with a chill roller, thereby forming the rapidly solidified alloy. It should be noted that if the rapidly solidified alloy obtained by the melt-quenching process has necessary crystalline phases, then the heat treatment process may be omitted.

In a preferred embodiment, the alloy thin strip that has just been rapidly cooled and solidified has a thickness of 70 μm to 300 μm as described above. When a melt spinning process such as a single roller process is adopted, the just rapidly solidified alloy thin strip can have a controlled thickness of 70 μm to 300 μm by adjusting the surface peripheral velocity of the chill roller within a range of 1 m/s to 13 m/s. The reasons why the thickness of the alloy thin strip is adjusted in this manner will be described below.

Specifically, if the roller surface peripheral velocity is lower than 1 m/s, then the resultant rapidly solidified alloy thin strip will have a thickness exceeding 300 μm. In that case, a rapidly solidified alloy structure, including a lot of excessively large α-Fe and $Fe_2B$, will be formed. Then, even when the alloy is thermally treated, no $R_2Fe_{14}B$ will be nucleated as a hard magnetic phase, and the desired permanent magnet performance cannot be achieved.

On the other hand, if the roller surface peripheral velocity is higher than 13 m/s, then the resultant rapidly solidified alloy thin strip will have a thickness that is smaller than 70 μm. In addition, when pulverized after having been thermally treated, the alloy thin strip easily fractures substantially perpendicularly to the roller contact surface (i.e., in the thickness direction of the alloy thin strip). As a result, the rapidly solidified alloy thin strip easily splits into flat pieces, and the resultant powder particles have aspect ratios that are smaller than 0.3. It is difficult to increase the flowability with such flat powder particles having aspect ratios that are less than 0.3.

In view of these considerations, in a preferred embodiment, the rapidly solidified alloy thin strip has its thickness controlled at 70 μm to 300 μm by adjusting the roller surface peripheral velocity. As a result, by performing the pulverizing process step, a rare-earth alloy powder having a mean particle size of at most 70 μm and aspect ratios of 0.4 to 1.0 can be obtained.

Before being thermally treated to be crystallized, the rapidly solidified alloy may have either an amorphous structure or a metal structure in which at least one metastable phase, selected from the group consisting of $Fe_{23}B_6$, $Fe_3B$, $R_2Fe_{14}B$ and $R_2Fe_{23}B_3$, and an amorphous phase coexist. If the cooling rate is relatively high, then the percentage of the metastable phase(s) decreases and the percentage of the amorphous phases increases. It should be noted that $Fe_3B$ will herein include $Fe_{3.5}B$, which is hard to distinguish from $Fe_3B$.

A nanometer-scale crystal, produced by thermally treating the rapidly solidified alloy, is made up of constituent phases including an Fe phase, an FeB compound phase and a compound phase having an $R_2Fe_{14}B$-type crystal structure. The average crystal grain size of the respective constituent phases is preferably 150 nm or less, more preferably 100 nm or less, and even more preferably 60 nm or less. According to the present invention, the alloy thin strip (with a thickness of 70 μm to 300 μm) yet to be pulverized is made up of such nanometer-scale crystals and is easily divided in random orientations as a result of the pulverizing process step. Thus, powder particles having an isometric shape (i.e., having an aspect ratio close to one) would be obtained relatively easily. That is to say, according to the present invention, the powder particles obtained will not be elongated in a particular orientation but will have an isometric (or quasi-spherical) shape.

On the other hand, if the alloy thin strip is made thinner than 70 μm by increasing the roller surface peripheral velocity, then the metal structure of the alloy thin strip tends to be aligned perpendicularly to the roller contact surface as described above. In that case, the alloy thin strip is easily divided in that orientation, and the powder particles obtained by the pulverization process are likely elongated parallel to the surface of the alloy thin strip. As a result, powder particles have aspect ratios that are less than 0.3.

Figure 1B:
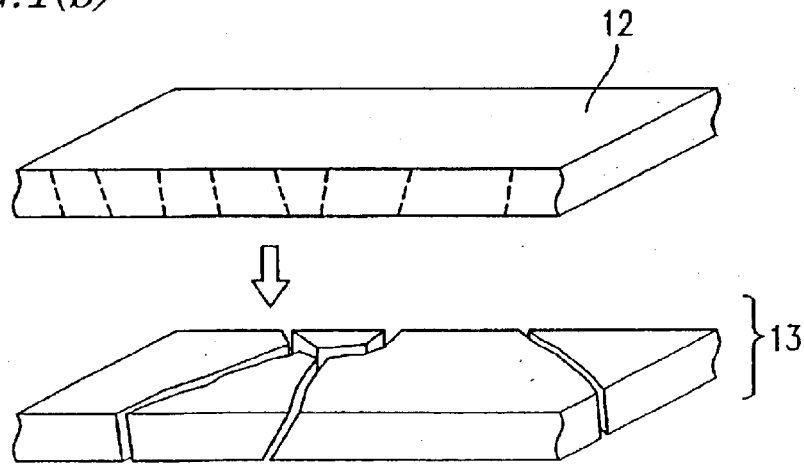

FIG. 1(*a*) schematically illustrates an alloy thin strip 10 that is yet to be subjected to a pulverization process and powder particles 11 obtained by the pulverization process in a method of making a rare-earth alloy powder according to the present invention. On the other hand, FIG. 1(*b*) schematically illustrates an alloy thin strip 12 that is yet to be subjected to a pulverization process and powder particles 13 obtained by the pulverization process in the conventional method of making a rare-earth alloy powder.

As shown in FIG. 1(*a*), in the present invention, the alloy thin strip 10 yet to be subjected to the pulverization process is made up of isometric crystals with small crystal grain sizes, and is likely divided in random orientations to produce isometric powder particles 11 easily. In the prior art on the other hand, the alloy thin strip 12 is likely divided substantially perpendicularly to the surface of thereof as shown in FIG. 1(*b*), thus producing flat and elongated particles 13.

If the molten alloy is rapidly cooled and solidified within a reduced-pressure atmosphere, nanometer-scale crystals (with an average grain size of 150 nm or less) of a compound having an $R_2Fe_{14}B$-type crystal structure can be formed uniformly even though the amount of rare-earth metal included is very small. As a result, a permanent magnet exhibiting excellent magnetic properties can be obtained.

In contrast, if the molten alloy having a composition represented by the general formula I described above is cooled within a normal pressure atmosphere, then the molten alloy will be cooled at inconstant cooling rates, thus creating crystals of α-Fe easily. As a result, no compound phase having the $R_2Fe_{14}B$-type crystal structure can be produced. Also, the inconstant cooling rates lead to nucleation of non-uniform phases. In that case, when such an alloy is thermally treated for crystallization purposes, the crystal grains will increase their sizes excessively also.

Furthermore, in the iron-based rare-earth alloy powder of the present invention, soft magnetic phases made of Fe and an FeB compound and a hard magnetic phase made of a compound having the $R_2Fe_{14}B$-type crystal structure coexist, and the average crystal grain sizes of the respective constituent phases are small, thus increasing the degree of exchange coupling.

Description of Preferred Composition

The reasons why the iron-based rare-earth alloy, having a composition represented by the general formula I: $(Fe_{1-m}T_m)_{100-x-y-z}Q_xR_yM_z$, where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb; and the mole fractions x, y, and z satisfy the inequalities of: 10 at %≦x≦30 at %; 2 at %≦y<10 at %; 0 at %≦z≦10 at %; and 0≦m≦0.5, respectively, is preferably used as the first iron-based rare-earth alloy will be described below.

The rare-earth element R is an element indispensable to $R_2Fe_{14}B$, which is a hard magnetic phase needed to achieve permanent magnet performance. If the mole fraction y of R is less than 2 at %, then the compound phase having the $R_2Fe_{14}B$-type crystal structure cannot be nucleated sufficiently. Accordingly, the coercivity can be increased just slightly and therefore sufficient hard magnetic properties are not achievable. However, if the mole fraction of R exceeds 10 at %, then Fe and the FeB compound will not be produced, no nanocomposite structure will be formed, and desired high magnetization is not achievable. In view of these considerations, the mole fraction y of the rare-earth element R preferably satisfies 2 at %≦y<10 at %, more preferably satisfies 3 at %≦y≦9.5 at %, and even more preferably satisfies 4 at %≦y≦9.2 at %.

Boron (B) is an element indispensable to iron-based borides such as $Fe_3B$ and $Fe_{23}B_6$, which constitute soft magnetic phases of a permanent magnet material, and to $R_2Fe_{14}B$, which constitutes a hard magnetic phase thereof. If the mole fraction x of B is less than 10 at %, amorphous phases cannot be produced so easily even when the molten alloy is rapidly cooled by the melt-quenching process. Accordingly, in that case, even if a rapidly solidified alloy is formed by rapidly cooling and solidifying the molten alloy by a single roller method under such conditions that the alloy has a thickness of 70 μm to 300 μm, no preferred metal structure can be produced. Even when such an alloy is thermally treated, no desired nanometer-scale crystals are created. Thus, even when this alloy is magnetized, sufficient permanent magnet performance will not be achieved. Furthermore, if the mole fraction x of B is less than 10 at %, then supercooled liquid state is not achievable even when the alloy is rapidly cooled by the melt-quenching process. Then, the metal structure will become non-uniform and no alloy thin strip with high smoothness can be obtained.

On the other hand, if the mole fraction x of B exceeds 30 at %, then $R_2Fe_{14}B$, which constitutes a hard magnetic phase, is not produced sufficiently, and the hard magnetic properties deteriorate, which is not preferable. For example, the loop squareness of the demagnetization curve decreases and the remanence $B_r$ drops. In view of these considerations, the boron mole fraction x preferably satisfies 10 at %≦x≦30 at %, and more preferably satisfies 10 at %<x and x≦20 at %. It should be noted that a portion of B may be replaced with C (carbon). By substituting C for a portion of B, the anticorrosiveness of the magnet can be increased without deteriorating the magnetic properties thereof. The quantity of C to replace B is preferably 30 at % or less of B. This is because the magnetic properties will deteriorate once the percentage of C exceeds this value.

T included in the first iron-based rare-earth alloy is typically Fe. Alternatively, a portion of Fe may be replaced with Co and/or Ni. However, if more than 50 at % of Fe is replaced with Co and/or Ni, then the percentage of the FeB compound will decrease and the magnetic properties will deteriorate unfavorably. Also, by substituting Co for a portion of Fe, the coercivity $H_{cJ}$ increases and the Curie temperature of the $R_2Fe_{14}B$ phase rises, thus increasing the thermal resistance. Furthermore, the Co substitution also increases the loop squareness and the maximum energy product as well. The percentage of Fe that is replaceable with Co is preferably 0.5 at % to 15 at % of Fe.

It should be noted that an element M (which is at least one element selected from the group consisting of Al, Si, Ti, V, Cr, Mn, Ni, Cu, Zn, Ga, Zr, Nb, Mo, Ag, Hf, Ta, W, Pt, Au and Pb) may be added to the material if necessary. By adding the element M, the loop squareness $J_r/J_s$ can be increased, the heat treatment temperature range and operating temperature range, in which the best magnetic properties are achieved, can be expanded, and other effects are achieved. To achieve these effects fully, the mole fraction z of the element M is preferably 0.05 at % or more. However, when the mole fraction z exceeds 10 at %, the magnetization starts to decrease. For that reason, the mole fraction z of the additive element M preferably satisfies 0.05 at %≦z≦10 at % and more preferably satisfies 0.1 at %≦z≦5 at %.

Hereinafter, a preferred embodiment of a method of making an iron-based rare-earth alloy powder according to the present invention will be described in detail.

First, a material represented by the general formula described above is prepared, and then heated and melted to obtain a molten alloy. The heating and melting process may be carried out with a high frequency heater, for example. Next, the molten alloy is rapidly cooled by a melt-quenching process, thereby forming a rapidly solidified alloy including amorphous phases. As the melt-quenching process, not only a melt spinning process using a single roller method but also a strip casting process may be carried out. Alternatively, as long as a rapidly solidified alloy thin strip with a thickness of 70 μm to 300 μm can be obtained, a melt solidifying machine with twin rollers may also be used.

Description of Melt Quenching Machine

Figure 2A:
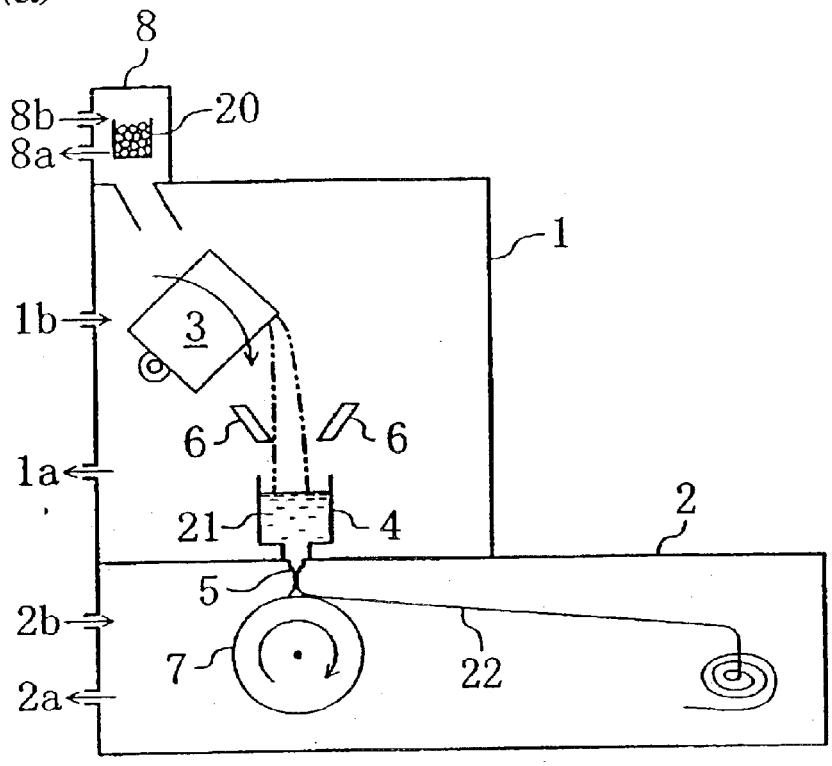
FIG. 2(*a*) is a view illustrating an exemplary configuration for a melt spinning machine (a single-roller machine) that can be used effectively in the present invention.
Figure 2B:
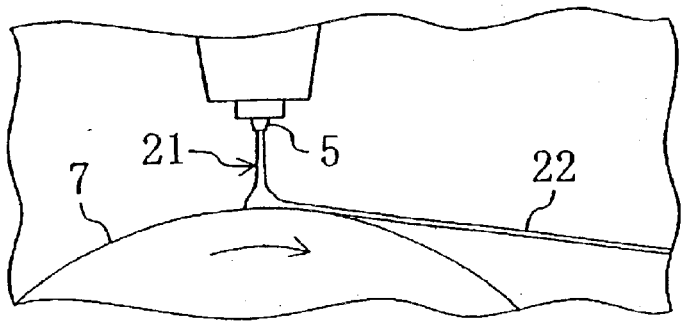

In this embodiment, a thin strip material alloy is prepared by using a melt spinning machine such as that shown in FIGS. 2(*a*) and 2(*b*). The thin strip alloy preparation process is performed within an inert atmosphere to prevent the material alloy, which includes easily oxidizable rare-earth element, from being oxidized. The inert gas is preferably a rare gas of helium or argon, for example. Nitrogen is not a preferred inert gas, because nitrogen reacts with the rare-earth element relatively easily.

The machine shown in FIG. 2(*a*) includes material alloy melting and quenching chambers 1 and 2, in which a vacuum or an inert atmosphere is maintained at an adjustable pressure.

The melting chamber 1 includes: a melt crucible 3 to melt, at an elevated temperature, a material 20 that has been mixed to have a desired magnet alloy composition; a reservoir 4 with a teeming nozzle 5 at the bottom; and a mixed material feeder 8 to supply the mixed material into the melt crucible 3 while maintaining an airtight condition. The reservoir 4 stores the melt 21 of the material alloy therein and is provided with a heater (not shown) to maintain the temperature of the melt teemed therefrom at a predetermined level.

The quenching chamber 2 includes a rotating chill roller 7 for rapidly cooling and solidifying the melt 21 that has been dripped through the teeming nozzle 5.

In this machine, the atmosphere and pressure inside the melting and quenching chambers 1 and 2 are controllable within prescribed ranges. For that purpose, atmospheric gas inlet ports 1*b*, 2*b* and 8*b* and outlet ports 1*a*, 2*a* and 8*a* are provided at appropriate positions of the machine. In particular, the gas outlet port 2*a* is connected to a pump to control the absolute pressure inside the quenching chamber 2 within a range of a vacuum (of at least 1.3 kPa, preferably) to 90 kPa.

The melt crucible 3 may define a desired tilt angle to pour the melt 21 through a funnel 6 into the reservoir 4 appropriately. The melt 21 is heated in the reservoir 4 by the heater (not shown).

The teeming nozzle 5 of the reservoir 4 is positioned on the boundary wall between the melting and quenching chambers 1 and 2 to drip the melt 21 in the reservoir 4 onto the surface of the chill roller 7, which is located under the nozzle 5. The orifice diameter of the teeming nozzle 5 may be 0.5 mm to 2.0 mm, for example. If the viscosity of the melt 21 is high, then the melt 21 cannot flow through the teeming nozzle 5 easily. In this embodiment, however, the pressure inside the quenching chamber 2 is kept lower than the pressure inside the melting chamber 1. Accordingly, an appropriate pressure difference is created between the melting and quenching chambers 1 and 2, and the melt 21 can be teemed smoothly.

The chill roller 7 is preferably made of Cu, Fe or an alloy including Cu or Fe. If the chill roller is made of a material other than Cu or Fe, the resultant rapidly solidified alloy cannot peel off the chill roller easily and might be wound around the roller. The chill roller 7 may have a diameter of 300 mm to 500 mm, for instance. The water-cooling capability of a water cooler provided inside the chill roller 7 is calculated and adjusted based on the latent heat of solidification and the volume of the melt teemed per unit time.

The surface of the chill roller 7 is coated with a chromium plating layer, for example. The surface roughness of the chill roller 7 is preferably defined such that the centerline average roughness Ra≦0.8 μm, the maximum roughness Rmax≦3.2 μm and the ten-point average roughness Rz≦3.2 μm. The surface of the chill roller 7 should not be too rough because the rapidly solidified alloy gets adhered to the roller easily in that case.

The machine shown in FIGS. 2(*a*) and 2(*b*) can rapidly solidify 20 kg of material alloy in 15 to 30 minutes, for example. The rapidly solidified alloy obtained in this manner is in the form of an alloy thin strip (or alloy ribbon) 22 with a thickness of 70 μm to 300 μm and a width of 2 mm to 6 mm, for example.

Description of Rapid Cooling Process

First, the melt 21 of the material alloy, which is represented by the general formula described above, is prepared and stored in the reservoir 4 of the melting chamber 1 shown in FIG. 2(*a*). Next, the melt 21 is dripped through the teeming nozzle 5 onto the water-cooled roller 7 to contact with, and be rapidly cooled and solidified by, the chill roller 7 within a low-pressure Ar atmosphere. In this case, an appropriate rapid solidification technique, making the cooling rate controllable precisely, should be adopted.

In this embodiment, the melt 21 is cooled and solidified at a cooling rate of $10^{3}$° C./s to $10^{5}$° C./s. At such a cooling rate, the temperature of the alloy is lowered by $\Delta T_1$. Before rapidly cooled, the molten alloy 21 has a temperature that is close to its melting point $T_m$ (which may be 1,200° C. to 1,300° C., for example). Accordingly, the temperature of the alloy decreases from $T_m$ to $(T_m-\Delta T_1)$ on the chill roller 7. The present inventors discovered via experiments that $\Delta T_1$ is preferably in the range of 700° C. to 1,100° C. to improve the resultant magnet performance.

A period of time during which the molten alloy 21 is cooled by the chill roller 7 is equivalent to an interval between a point in time the alloy contacts with the outer circumference of the rotating chill roller 7 and a point in time the alloy leaves the roller 7, and may be 0.05 millisecond to 50 milliseconds in this embodiment. In this period of time, the alloy has its temperature further decreased by $\Delta T_2$ and is solidified. Thereafter, the solidified alloy leaves the chill roller 7 and travels within the inert atmosphere. While the thin-strip alloy is traveling, the alloy has its heat dissipated into the atmospheric gas. As a result, the temperature of the alloy further decreases to $(T_m-\Delta T_1-\Delta T_2)$ $\Delta T_2$ changes with the size of the machine or the pressure of the atmospheric gas but is typically about 100° C. or more.

It should be noted that the atmosphere inside of the quenching chamber 2 has a reduced pressure. The atmosphere is preferably an inert gas with an absolute pressure of 90 kPa or less. If the pressure of the atmospheric gas exceeds 90 kPa, then significant effects will be caused due to the absorption of the atmospheric gas into the gap between the rotating roller and the molten alloy. This is not preferable because the desired uniform structure may not be obtained in that case.

According to the present invention, the thickness of the rapidly solidified alloy thin strip is controlled to the range of 70 μm to 300 μm by adjusting the roller surface peripheral velocity within the range of 1 m/s to 13 m/s. The reason is as follows. Specifically, if the roller surface peripheral velocity is less than 1 m/s, a sufficient melt quenching rate is not achievable, α-Fe with an excessively large grain size nucleates, and the hard and soft magnetic phases have too large an average crystal grain size. Then, desired magnetic properties are not achievable, which is not preferable. On the other hand, if the roller surface peripheral velocity exceeds 13 m/s, then the thickness of the rapidly solidified alloy thin strip will be less than 70 μm and nothing but powder particles with aspect ratios (i.e., the ratio of the minor-axis size to the major-axis size) that are less than 0.3 can be obtained in the pulverizing process to be described later.

Description of Heat Treatment

After the rapid cooling process has been carried out, the resultant rapidly solidified alloy is thermally treated and crystallized, thereby producing nanometer-scale crystals with an average crystal grain size of 100 nm or less. This heat treatment process is preferably carried out at a temperature of 400° C. to 700° C. (more preferably 500° C. to 700° C.) for 30 seconds or more. The reason is as follows. Specifically, if the heat treatment temperature exceeds 700° C., then the grain coarsening is so significant as to deteriorate the magnetic properties seriously. However, if the heat treatment temperature is less than 400° C., then no $R_2Fe14B$ phase will nucleate and high coercivity cannot be achieved.

If the heat treatment process is carried out under the conditions described above, nanometer-scale crystals (of Fe, the FeB compound and the compound having the $R_2Fe_{14}B$-type crystal structure) can be produced so as to have an average crystal grain size of 150 nm or less. A preferred heat treatment time changes with the heat treatment temperature. For example, when the heat treatment process is carried out at 600° C., then the alloy is preferably heated for about 30 seconds to about 30 minutes. If the heat treatment time is less than 30 seconds, the crystallization may be incomplete.

Before being thermally treated, the alloy is preferably coarsely pulverized into a powder with a mean particle size of about 1 mm to about 30 μm. This is because the alloy can be thermally treated more uniformly in that case.

Ti-containing First Iron-based Rare-earth Alloy

The first iron-based rare-earth alloy powder is preferably an iron-based rare-earth alloy that has a composition represented by the general formula II:

$$(Fe_{1-m}T_m)_{100-x-y-z}Q_xR_yM_z$$

where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb and always includes Ti; and the mole fractions x, y, z and m satisfy the inequalities of: 10 at %<x≦20 at %; 6 at %<y<10 at %; 0.1 at %≦z≦12 at %; and 0≦m≦0.5, respectively. Such an alloy will be referred to herein as a "Ti-containing first iron-based rare-earth alloy". If M includes at least one element other than Ti, the atomic ratio of Ti to M is preferably at least 70%, more preferably at least 90%.

Also, the mole fractions x and z preferably satisfy the inequality z/x≧0.1 and more preferably satisfy the inequality z/x≧0.15.

Also, the Ti-containing first iron-based rare-earth alloy preferably includes at least two ferromagnetic crystalline phases, of which the hard magnetic phases preferably have an average crystal grain size of 5 nm to 200 nm and the soft magnetic phases preferably have an average crystal grain size of 1 nm to 100 nm.

In the Ti-containing first iron-based rare-earth alloy, the mole fractions x, y, z and m of the general formula II described above preferably satisfy the inequalities of: 10 at %<x<17 at %; 7 at %≦y≦9.3 at %; and 0.5 at %≦z≦6 at %, respectively. More preferably, 8 at %≦y≦9.0 at % is satisfied. It should be noted that when 15 at %<x≦20 at %, 3.0 at %<z<12 at % is preferably satisfied.

The Ti-containing first iron-based rare-earth alloy has the composition and structure described above. Accordingly, in the rare-earth alloy, the hard and soft magnetic phases thereof are coupled together through magnetic exchange interactions. Thus, although the iron-based rare-earth alloy includes a rare-earth element at a relatively low mole fraction, the alloy still exhibits excellent magnetic properties that are at least comparable to, or even better than, those of a conventional rapidly solidified magnet powder. Specifically, the Ti-containing first iron-based rare-earth alloy achieves a maximum energy product $(BH)_{max}$ of at least 80 kJ/m$^3$, a coercivity $H_{cJ}$ of at least 480 kA/m and a remanence $B_r$ of at least 0.7 T, and may have a maximum energy product $(BH)_{max}$ of 90 kJ/m$^3$ or more, a coercivity $H_{cJ}$ of 550 kA/m or more and a remanence $B_r$ of 0.8 T or more (see the fourth example and Table 10 to be described later).

The Ti-containing first iron-based rare-earth alloy is formed by rapidly cooling and solidifying a melt of an Fe—R—B alloy containing Ti and represented by the general formula II described above. This rapidly solidified alloy includes crystalline phases. However, if necessary, the alloy is heated and further crystallized.

When Ti is added to an iron-based rare-earth alloy with a composition defined by a particular combination of mole fraction ranges, the nucleation and growth of an α-Fe phase, often observed while the melt is cooled and obstructing the expression of excellent magnetic properties (e.g., high coercivity and good loop squareness of the demagnetization curve among other things), can be minimized and the crystal growth of an $R_2Fe_{14}B$ compound phase, contributing to hard magnetic properties, can be advanced preferentially and uniformly.

Unless Ti is added, the α-Fe phase easily nucleates and grows faster and earlier than an $Nd_2Fe_{14}B$ phase. Accordingly, when the rapidly solidified alloy is thermally treated to be crystallized, the α-Fe phase with soft magnetic properties will have grown excessively and no excellent magnetic properties (e.g., $H_{cJ}$ and loop squareness, in particular) will be achieved.

In contrast, where Ti is added, the nucleation and growth kinetics of the α-Fe phase would be slowed down, i.e., it would take a longer time for the α-Fe phase to nucleate and grow. Thus, the present inventors believe that the $Nd_2Fe_{14}B$ phase would start to nucleate and grow before the α-Fe phase has nucleated and grown coarsely. For that reason, the $Nd_2Fe_{14}B$ phase can be grown sufficiently and distributed uniformly before the α-Fe phase grows too much. Furthermore, it is believed that Ti is hardly included in the $Nd_2Fe_{14}B$ phase, but present profusely in the iron-based boride or in the interface between the $Nd_2Fe_{14}B$ phase and the iron-based boride phase, thus stabilizing the iron-based boride.

That is to say, the Ti-containing first iron-based rare-earth alloy can have a nanocomposite structure in which Ti contributes to significant reduction in grain size of the soft magnetic phases (including the iron-based boride and α-Fe phases), uniform distribution of the $Nd_2Fe_{14}B$ phase and increase in volume percentage of the $Nd_2Fe14B$ phase. As a result, compared to the situation where no Ti is added, the coercivity and magnetization (or remanence) increase and the loop squareness of the demagnetization curve improves, thus contributing to achieving excellent magnetic properties in the resultant bonded magnet.

Naturally, a powder having aspect ratios of 0.4 to 1.0 can be obtained from the Ti-containing first iron-based rare-earth alloy as well as from the second iron-based rare-earth alloy described above. Thus, by mixing the first iron-based rare-earth alloy powder with the second iron-based rare-earth alloy powder, the flowability and compactability of an iron-based rare-earth alloy powder for use to make a bonded magnet can be improved.

Hereinafter, the Ti-containing first iron-based rare-earth alloy will be described in further detail.

The Ti-containing first iron-based rare-earth alloy preferably has a composition represented by the general formula: $(Fe_{1-m}T_m)_{100-x-y-z}Q_xR_yM_z$, where T is at least one element selected from the group consisting of Co and Ni; Q is at least one element selected from the group consisting of B (boron) and C (carbon) and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb and always includes Ti; and the mole fractions x, y, z and m preferably satisfy the inequalities of: 10 at %<x≦20 at %; 6 at %<y<10 at %; 0.1 at %≦z≦12 at %; and 0≦m≦0.5, respectively.

The Ti-containing first iron-based rare-earth alloy includes a rare-earth element at as small a mole fraction as less than 10 at %. However, since Ti has been added, the alloy achieves the unexpected effects of keeping, or even increasing, the magnetization (remanence) and improving the loop squareness of the demagnetization curve thereof compared to the situation where no Ti is added.

In the Ti-containing first iron-based rare-earth alloy, the soft magnetic phases have a very small grain size. Accordingly, the respective constituent phases are coupled together through exchange interactions. For that reason, even though soft magnetic phases such as iron-based boride and α-Fe phases are present along with the hard magnetic $R_2Fe_{14}B$ compound phase, the alloy as a whole can exhibit excellent squareness at the demagnetization curve thereof.

The Ti-containing first iron-based rare-earth alloy preferably includes iron-based borides and α-Fe phases with a saturation magnetization equal to, or even higher than, that of the $R_2Fe_{14}B$ compound phase. Examples of those iron-based borides include $Fe_3B$ (with a saturation magnetization of 1.5 T) and $Fe_{23}B_6$ (with a saturation magnetization of 1.6 T). In this case, the $R_2Fe_{14}B$ phase has a saturation magnetization of about 1.6 T when R is Nd, and the α-Fe phase has a saturation magnetization of 2.1 T.

Normally, where the mole fraction x of B is greater than 10 at % and the mole fraction y of the rare-earth element R is 5 at % to 8 at %, $R_2Fe_{23}B_3$ is produced. However, even when a material alloy with such a composition is used, the addition of Ti as is done in the present invention can produce $R_2Fe_{14}B$ phase and soft magnetic iron-based boride phases such as $Fe_{23}B_6$ and $Fe_3B$, instead of the unwanted $R_2Fe_{23}B_3$ phase. That is to say, when Ti is added, the percentage of the $R_2Fe_{14}B$ phase can be increased and the iron-based boride phases produced contribute to increasing the magnetization.

The present inventors discovered via experiments that only when Ti was added, the magnetization did not decrease but rather increased as opposed to any other metal element additive such as V, Cr, Mn, Nb or Mo. Also, when Ti was added, the loop squareness of the demagnetization curve was much better than that obtained by adding any of these elements.

Furthermore, these effects achieved by the additive Ti are particularly significant where the concentration of B is greater than 10 at %. Hereinafter, this point will be described with reference to FIG. 3.

Figure 3:
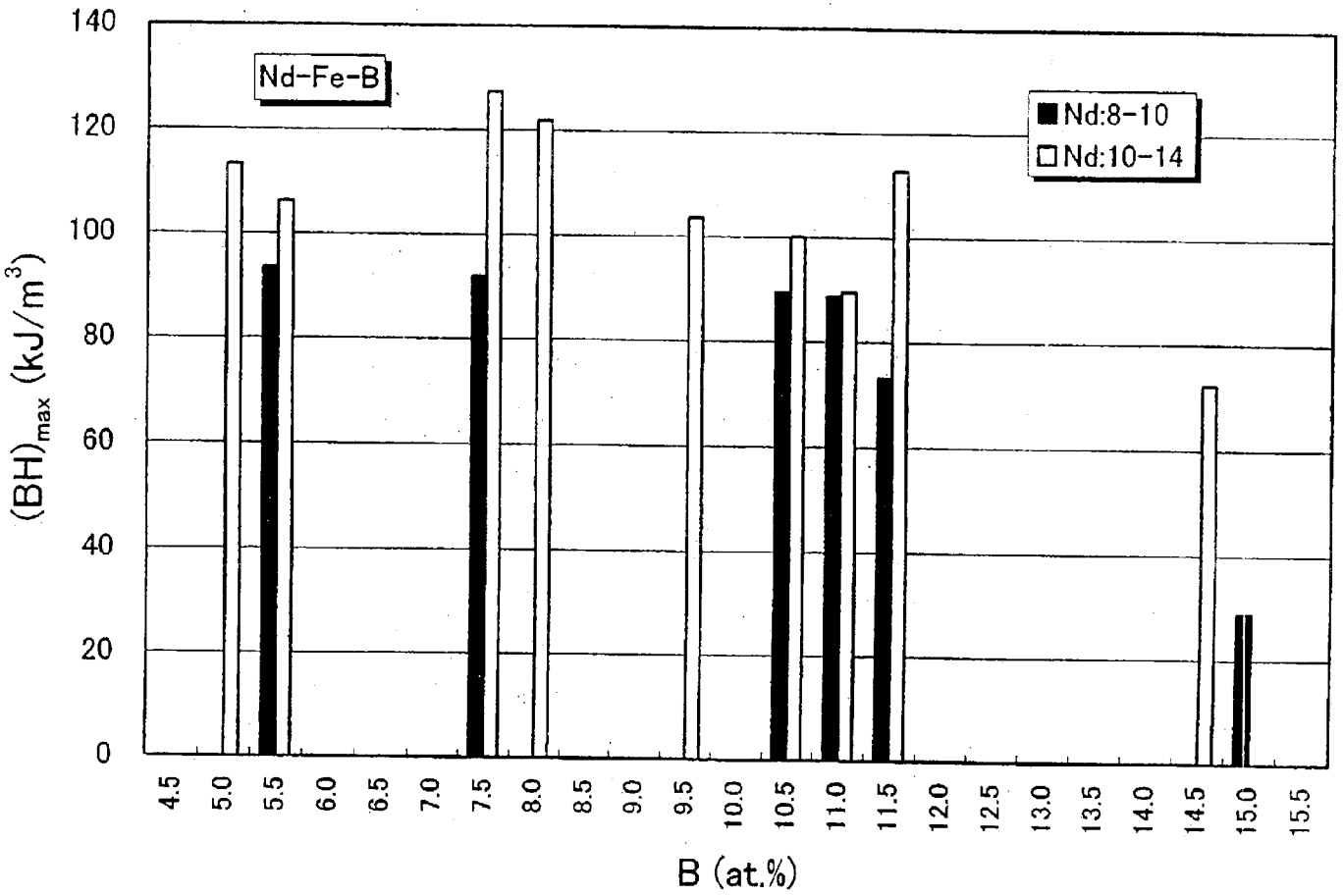
FIG. 3 is a graph showing a relationship between the maximum energy product $(BH)_{max}$ and the concentration of boron in an Nd—Fe—B nanocomposite magnet including no additive Ti, in which the white bars represent data about samples containing 10 at % to 14 at % of Nd, while the black bars represent data about samples containing 8 at % to 10 at % of Nd.
Figure 4:
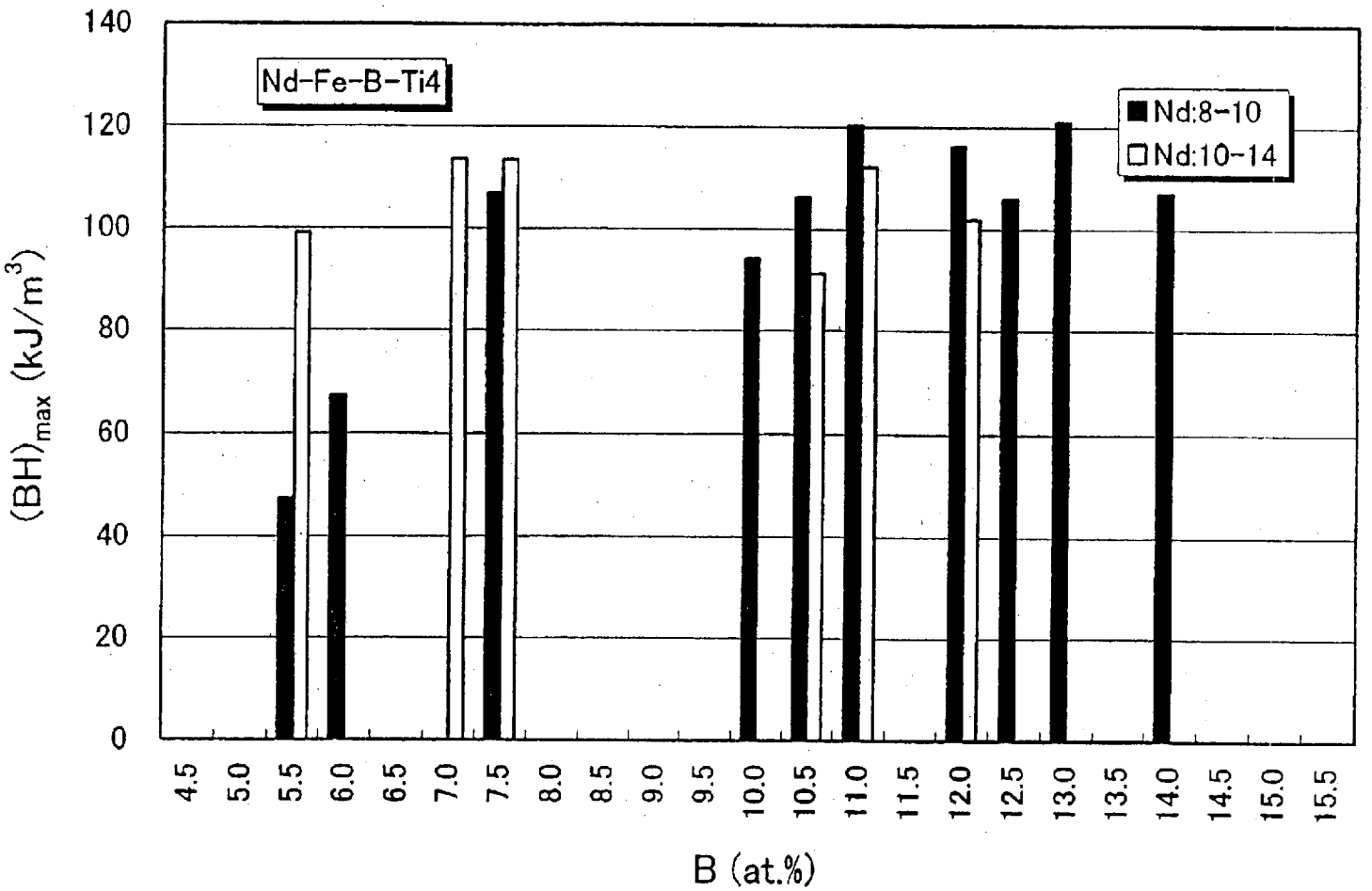
FIG. 4 is a graph showing a relationship between the maximum energy product $(BH)_{max}$ and the concentration of boron in an Nd—Fe—B nanocomposite magnet including additive Ti, in which the white bars represent data about samples containing 10 at % to 14 at % of Nd, while the black bars represent data about samples containing 8 at % to 10 at % of Nd.

FIG. 3 is a graph showing a relationship between the maximum energy product $(BH)_{max}$ and the concentration of B in an Nd—Fe—B magnet alloy to which no Ti is added. In FIG. 3, the white bars represent data about samples containing 10 at % to 14 at % of Nd, while the black bars represent data about samples containing 8 at % to less than 10 at % of Nd. On the other hand, FIG. 4 is a graph showing a relationship between the maximum energy product $(BH)_{max}$ and the concentration of B in an Nd—Fe—B magnet alloy to which Ti is added. In FIG. 4, the white bars represent data about samples containing 10 at % to 14 at % of Nd, while the black bars represent data about samples containing 8 at % to less than 10 at % of Nd.

As can be seen from FIG. 3, once the concentration of B exceeds 10 at %, the samples including no Ti exhibit decreased maximum energy products $(BH)_{max}$ no matter how much Nd is contained therein. Where the content of Nd is 8 at % to 10 at %, this decrease is particularly noticeable. This tendency has been well known in the art and it has been widely believed that any magnet alloy, including an $Nd_2Fe_{14}B$ phase as its main phase, should not contain more than 10 at % of B. For instance, U.S. Pat. No. 4,836,868 discloses a working example in which B has a concentration of 5 at % to 9.5 at %. This patent teaches that the concentration of B is preferably 4 at % to less than 12 at %, more preferably 4 at % to 10 at %.

In contrast, as can be seen from FIG. 4, the samples including the additive Ti show increased maximum energy products $(BH)_{max}$ in a certain range where the B concentration is greater than 10 at %. This increase is particularly remarkable where the Nd content is 8 at % to 10 at %.

Thus, the present invention can reverse the conventional misbelief that a B concentration of greater than 10 at % degrades the magnetic properties and can achieve the unexpected effects just by adding Ti.

Next, a method of making the Ti-containing first iron-based rare-earth alloy will be described.

A melt of the iron-based alloy with the composition represented by the general formula II: $(Fe_{1-m}T_m)_{100-x-y-z}Q_xR_yM_z$(where x, y, z and m satisfy 10 at %<x□20 at %, 6 at %□y<10 at %, 0.1 at %□z□12 at % and 0□m□0.5, respectively) is rapidly cooled within an inert atmosphere, thereby preparing a rapidly solidified alloy including an $R_2Fe_{14}B$ compound phase at 60 volume % or more, for example. The average crystal grain size of the $R_2Fe_{14}B$ compound phase in the rapidly solidified alloy can be 80 nm or less, for example. If necessary, this rapidly solidified alloy may be heat-treated. Then, the amorphous phases remaining in the rapidly solidified alloy can be crystallized.

In an embodiment in which a melt spinning process or a strip casting process is carried out by using a chill roller, the molten alloy is rapidly cooled within an atmosphere having a pressure of 1.3 kPa or more. Then, the molten alloy is not just rapidly cooled through the contact with the chill roller but also further cooled appropriately due to the secondary cooling effects caused by the atmospheric gas even after the solidified alloy has left the chill roller.

According to the results of experiments the present inventors carried out, while the rapid cooling process is performed, the atmospheric gas should have its pressure controlled preferably at 1.3 kPa or more but the atmospheric pressure (=101.3 kPa) or less, more preferably 10 kPa to 90 kPa, and even more preferably 20 kPa to 60 kPa.

Where the atmospheric gas has a pressure falling within any of these preferred ranges, the surface velocity of the chill roller is preferably 4 m/s to 50 m/s. This is because if the roller surface velocity is lower than 4 m/s, then the $R_2Fe_{14}B$ compound phase, included in the rapidly solidified alloy, will have excessively large crystal grains. In that case, the $R_2Fe_{14}B$ compound phase will further increase its grain size when thermally treated, thus possibly deteriorating the resultant magnetic properties.

According to the experimental results the present inventors obtained, the roller surface velocity is more preferably 5 m/s to 30 m/s, even more preferably 5 m/s to 20 m/s.

When a material alloy having the composition of the Ti-containing first iron-based rare-earth alloy is rapidly cooled and solidified, the resultant rapidly solidified alloy has either a structure in which almost no α-Fe phase with an excessively large grain size precipitates but a microcrystalline $R_2Fe_{14}B$ compound phase exists instead or a structure in which the microcrystalline $R_2Fe_{14}B$ compound phase and an amorphous phase coexist. Accordingly, when such a rapidly solidified alloy is thermally treated, a high-performance nanocomposite magnet, in which soft magnetic phases such as iron-based boride phases are dispersed finely or distributed uniformly on the grain boundary between the hard magnetic phases, will be obtained. As used herein, the "amorphous phase" means not only a phase in which the atomic arrangement is sufficiently disordered but also a phase including embryos for crystallization, extremely small crystalline regions (with a size of several nanometers or less), and/or atomic clusters. More specifically, the "amorphous phase" herein means any phase of which the crystal structure cannot be defined by an X-ray diffraction analysis or a TEM observation.

In the prior art, even when one tries to obtain a rapidly solidified alloy including 60 volume % or more of $R_2Fe_{14}B$ compound phase by rapidly cooling a molten alloy with a composition that is similar to that of the Ti-containing first iron-based rare-earth alloy but that includes no Ti, the resultant alloy will have a structure in which a lot of α-Fe phase has grown coarsely. Thus, when the alloy is heated and crystallized after that, the α-Fe phase will increase its grain size excessively. Once soft magnetic phases such as the α-Fe phase have grown too much, the magnetic properties of the alloy sometimes deteriorate significantly.

Particularly with a material alloy containing B at a relatively high percentage like the Ti-containing first iron-based rare-earth alloy, even if the molten alloy is cooled at a low rate, crystalline phases cannot be produced so easily according to the conventional method. This is because the B-rich molten alloy highly likely creates an amorphous phase. For that reason, in the prior art, even if one tries to make a rapidly solidified alloy including 60 volume % or more of $R_2Fe_{14}B$ compound phase by decreasing the cooling rate of the melt sufficiently, not only the $R_2Fe_{14}B$ compound phase but also the α-Fe phase or its precursor will precipitate a lot. Thus, when that alloy is heated and crystallized after that, the α-Fe phase will further grow to deteriorate the magnetic properties of the alloy seriously.

Thus, it was widely believed that the best way of increasing the coercivity of a material alloy for a nanocomposite magnet was cooling a melt at an increased rate to amorphize most of the rapidly solidified alloy first and then forming a highly fine and uniform structure by heating and crystallizing the amorphous phases. This is because in conventional methods, it was taken for granted that there was no other alternative but crystallizing the amorphous phases through an easily controllable heat treatment process to obtain a nanocomposite magnet having an alloy structure in which crystalline phases of very small sizes are dispersed.

Based on this popular belief, W. C. Chan et al., reported a technique of obtaining $Nd_2Fe_{14}B$ and α-Fe phases with grain sizes on the order of several tens nm. According to Chan's technique, La, which excels in producing the amorphous phases, is added to a material alloy. Next, the material alloy is melt quenched to obtain a rapidly solidified alloy mainly composed of the amorphous phases. And then the alloy is heated and crystallized. See W. C. Chan et al., "The Effects of Refractory Metals on the Magnetic Properties of α-Fe/$R_2Fe_{14}B$-type Nanocomposites", IEEE Trans. Magn. No. 5, INTERMAG. 99, Kyongiu, Korea, pp. 3265–3267, 1999. This article also teaches that adding a refractory metal element such as Ti in a very small amount (e.g., 2 at %) improves the magnetic properties and that the mole fraction of Nd, rare-earth element, is preferably increased from 9.5 at % to 11.0 at % to reduce the grain sizes of the $Nd_2Fe_{14}B$ and α-Fe phases. The refractory metal is added to prevent borides such as $R_2Fe_{23}B_3$ and $Fe_3B$ from being produced and to make a material alloy for a magnet powder consisting essentially of $Nd_2Fe_{14}B$ and α-Fe phases only.

In contrast, in the Ti-containing first iron-based rare-earth alloy, the additive Ti minimizes the nucleation of the α-Fe phase during the rapid solidification process. In addition, the additive Ti also produces soft magnetic phases such as iron-based borides and yet minimizes the grain growth thereof during the heat treatment process for crystallization. As a result, a magnet powder having excellent magnetic properties can be obtained.

That is to say, even though the material alloy includes a rare-earth element at a relatively low percentage (i.e., 9 at % or less), a magnet powder, exhibiting high magnetization (or remanence) and coercivity and showing excellent loop squareness at its demagnetization curve, can be obtained.

As described above, the coercivity of the Ti-containing first iron-based rare-earth alloy is increased by making the $Nd_2Fe_{14}B$ phase nucleate and grow faster and earlier in the cooling process so that the $Nd_2Fe_{14}B$ phase increases its volume percentage and yet by minimizing the grain coarsening of the soft magnetic phases. Also, the magnetization thereof increases because the additive Ti can produce a boride phase (e.g., ferromagnetic iron-based borides) from the B-rich amorphous phases existing in the rapidly solidified alloy and can increase the volume percentage of the ferromagnetic phases in the heated and crystallized alloy.

The material alloy obtained in this manner is preferably heated and crystallized depending on the necessity to form a structure with three or more crystalline phases including $R_2Fe_{14}B$ compound, boride and α-Fe phases. The heat treatment is preferably conducted with its temperature and duration controlled in such a manner that the $R_2Fe_{14}B$ compound phase will have an average crystal grain size of 5 nm to 200 nm and that the boride and α-Fe phases will have an average crystal grain size of 1 nm to 100 nm. The $R_2Fe_{14}B$ compound phase normally has an average crystal grain size of 30 nm or more, which may be 50 nm or more depending on the conditions. On the other hand, the soft magnetic phases, such as boride and α-Fe phases, often have an average crystal grain size of 50 nm or less, 30 nm or less in many cases, and typically several nanometers at most.

Figure 5:
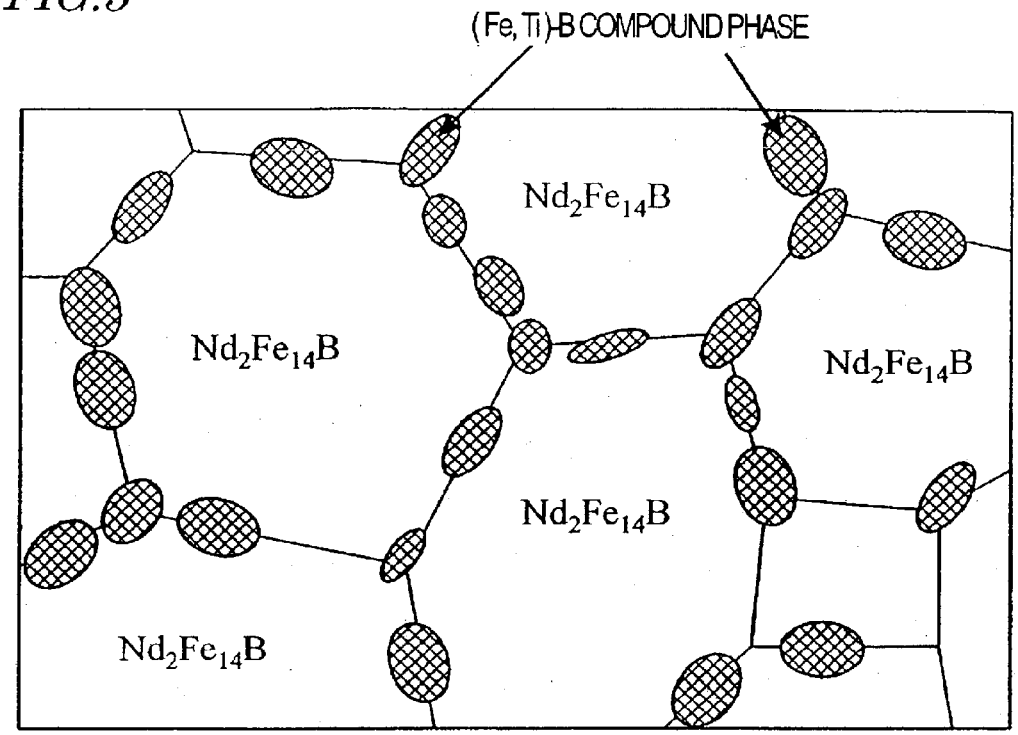
FIG. 5 schematically illustrates an $R_2Fe_{14}B$ compound phase and an (Fe, Ti)—B phase in the magnet of the present invention.

In the Ti-containing first iron-based rare-earth alloy, the $R_2Fe_{14}B$ compound phase has a greater average crystal grain size than the soft magnetic phases such as Fe—B and α-Fe phases. FIG. 5 schematically illustrates the metal structure of this material alloy. As shown in FIG. 5, fine soft magnetic phases are distributed between relatively large $R_2Fe_{14}B$ compound phases. Even though the $R_2Fe_{14}B$ compound phase has a relatively large average crystal grain size, the soft magnetic phases have a sufficiently small average crystal grain size because the crystal growth thereof has been minimized. Accordingly, these constituent phases are magnetically coupled together through exchange interactions and the magnetization directions of the soft magnetic phases are constrained by the hard magnetic phase. Consequently, the alloy as a whole can exhibit excellent loop squareness at its demagnetization curve.

In the manufacturing process described above, borides are easily produced. The reason is believed to be as follows. When a solidified alloy, mostly composed of the $R_2Fe_{14}B$ compound phase, is made, the amorphous phases existing in the rapidly solidified alloy should contain an excessive amount of B. Accordingly, when the alloy is heated and crystallized, that B will bond to other elements easily, thus nucleating and growing in profusion. However, if that B bonds to other elements and produces compounds with low magnetization, then the alloy as a whole will have decreased magnetization.

The present inventors discovered and confirmed via experiments that only when Ti was added, the magnetization did not decrease but rather increased as opposed to any other metal element additive such as V, Cr, Mn, Nb or Mo. Also, the additive Ti improved the loop squareness of the demagnetization curve far better than any of the elements cited above did. Accordingly, the present inventors believe that Ti plays a key role in minimizing the production of borides with low magnetization. Particularly when relatively small amounts of B and Ti are included in the material alloy for use to prepare the Ti-containing first iron-based rare-earth alloy, iron-based boride phases with ferromagnetic properties will easily grow while the alloy is heat-treated. In that case, B included in the non-magnetic amorphous phases would be absorbed into the iron-based borides. As a result, the non-magnetic amorphous phases, remaining even in the alloy that has been heated and crystallized, decrease their volume percentage but the ferromagnetic crystalline phase increases its volume percentage instead, thus increasing the remanence $B_r$.

Hereinafter, this point will be further discussed with reference to FIG. 6.

Figure 6:
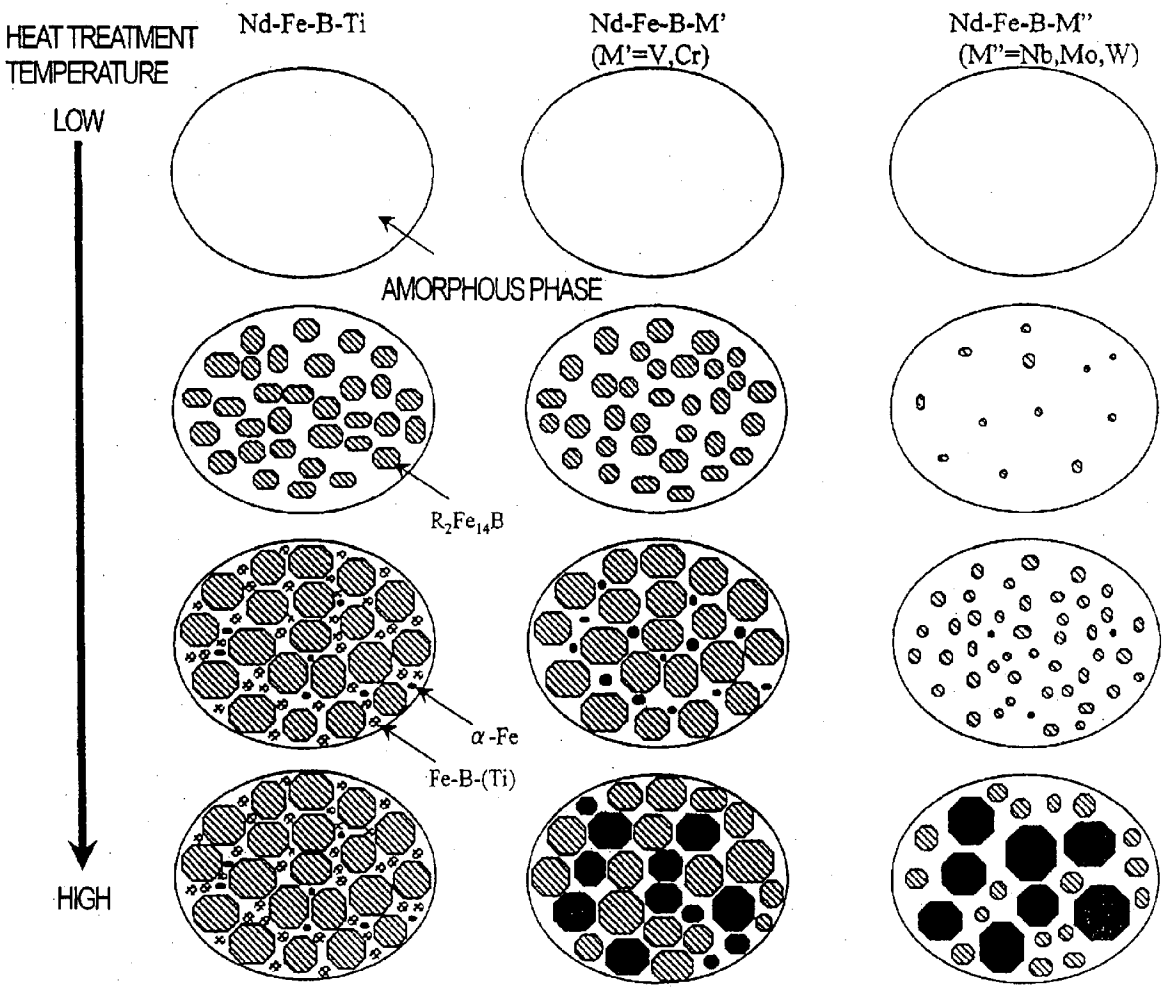
FIG. 6 schematically illustrates how rapidly solidified alloys change their microstructures during the crystallization processes thereof in a situation where Ti is added and in situations where Nb or another metal element is added instead of Ti.

FIG. 6 schematically illustrates how rapidly solidified alloys change their microstructures during the crystallization processes thereof in a situation where Ti is added and in situations where Nb or another metal element is added instead of Ti. Where Ti is added, the grain growth of the respective constituent phases is minimized even in a temperature range exceeding the temperature at which the α-Fe phase grows rapidly. As a result, excellent hard magnetic properties can be maintained. In contrast, where any of the other metal elements (e.g., Nb, V, Cr, etc.) is added, the grain growth of the respective constituent phases advances remarkably and the exchange interactions among those phases weakens in the relatively high temperature range in which the α-Fe phase grows rapidly. As a result, the resultant demagnetization curves have decreased loop squareness.

First, the situation where Nb, Mo or W is added will be described. In this case, if the alloy is thermally treated in a relatively low temperature range where no α-Fe phase precipitates, then good hard magnetic properties, including superior loop squareness of the demagnetization curve, are achievable. In an alloy that was heat-treated at such a low temperature, however, $R_2Fe_{14}B$ microcrystalline phases would be dispersed in the non-magnetic amorphous phases, and the alloy does not have the nanocomposite magnet structure and would not exhibit high magnetization. Also, if the alloy is heat-treated at a higher temperature, then the α-Fe phase nucleates and grows out of the amorphous phases. Unlike the situation where Ti is added, the α-Fe phase grows rapidly and increases its grain size excessively. As a result, the exchange interactions among the constituent phases weaken and the loop squareness of the demagnetization curve deteriorates significantly.

On the other hand, where Ti is added, a nanocomposite structure, including microcrystalline $R_2Fe_{14}B$, iron-based boride, α-Fe and amorphous phases, can be obtained by heat-treating the alloy, and the respective constituent phases are dispersed finely and uniformly. Also, the addition of Ti minimizes the grain growth of the α-Fe phase.

Where V or Cr is added, any of these additive metal elements is coupled anti-ferromagnetically with Fe to form a solid solution, thus decreasing the magnetization significantly. The additive V or Cr cannot minimize the heat-treatment-induced grain growth sufficiently, either, and deteriorates the loop squareness of the demagnetization curve.

Thus, only when Ti is added, the grain coarsening of the α-Fe phase can be minimized appropriately and iron-based borides with ferromagnetic properties can be obtained. Furthermore, Ti, as well as B and C, plays an important role as an element that delays the crystallization of Fe initial crystals (i.e., γ-Fe that will be transformed into α-Fe) during the melt quenching process and thereby facilitates the production of a supercooled liquid. Accordingly, even if the melt of the alloy is rapidly cooled and solidified at a relatively low cooling rate of about $10^{2°}$ C./s to about $10^{5°}$ C./s, a rapidly solidified alloy, in which the α-Fe phase has not precipitated too much and the microcrystalline $R_2Fe_{14}B$ and amorphous phases coexist, can be obtained. This greatly contributes to cost reduction because this means that a strip casting process, particularly suitable for mass production, can be selected from various melt quenching techniques.

The strip casting process is a highly productive and cost-effective method for obtaining a material alloy by rapidly cooling a molten alloy. This is because in the strip casting process, the flow rate of the melt does not have to be controlled using a nozzle or orifice but the melt may be poured directly from a tundish onto a chill roller. To amorphize the melt of an R—Fe—B rare-earth alloy in a cooling rate range achievable even by the strip casting process, normally B should be added at 10 at % or more. In the prior art, however, if B is added that much, then not just non-magnetic amorphous phases but also an α-Fe phase and/or a soft magnetic $Nd_2Fe_{23}B_3$ phase will grow preferentially to have excessively large grain sizes when the rapidly solidified alloy is thermally treated and crystallized. Then, no uniform microcrystalline structure can be obtained. As a result, the volume percentage of ferromagnetic phases decreases, the magnetization drops, and the volume percentage of the $Nd_2Fe_{14}B$ phase also decreases. Consequently, the coercivity decreases noticeably. However, if Ti is added, then the excessive grain growth of the α-Fe phase is minimized as described above. As a result, the magnetization increases more than expected.

It should be noted that a rapidly solidified alloy, including the $Nd_2Fe_{14}B$ phase at a high volume percentage, could improve the resultant magnetic properties more easily than a rapidly solidified alloy including the amorphous phases at a high volume percentage. Accordingly, the volume percentage of the $Nd_2Fe_{14}B$ phase to the overall rapidly solidified alloy is preferably 50 volume % or more, more specifically 60 volume % or more, which value was obtained by M össbauer spectroscopy.

Next, the Ti-containing first iron-based rare-earth alloy may be prepared by a rapid cooling process that results in a relatively low cooling rate due to the effects achieved by the additive Ti. The rapidly solidified alloy may be prepared either by the melt spinning machine shown in FIG. 2 as in the first iron-based rare-earth alloy or by a strip casting process or any of various other methods using no nozzle or orifice. Also, the single roller method described above may be replaced with a twin roller method that uses a pair of chill rollers.

The cooling rate is preferably $1\times10^{2\circ}$ C./s to $1\times10^{8\circ}$ C./s, more preferably $1\times10^{4\circ}$ C./s to $1\times10^{6\circ}$ C./s. By controlling the roller surface velocity within the range of 10 m/s to 30 m/s and the atmospheric gas pressure at 30 kPa or more to enhance the secondary cooling effects caused by the atmospheric gas, a rapidly solidified alloy including at least 60 vol % of $R_2Fe_{14}B$ compound phase having as small an average crystal grain size as 80 nm or less can be obtained.

Among these rapid cooling techniques, the strip casting method results in a relatively low cooling rate, i.e., $10^{2\circ}$ C./s to $10^{5\circ}$ C./s. By adding an appropriate volume of Ti to the material alloy, a rapidly solidified alloy, most of which has a structure including no Fe initial crystals, can be obtained even by the strip casting process. The process cost of the strip casting method is about half or less of any other melt quenching process. Accordingly, to prepare a large quantity of rapidly solidified alloy, the strip casting method is much more effective than the melt spinning method, and is suitably applicable to mass production. However, if no element M is added to the material alloy or if Cr, V, Mn, Mo, Ta and/or W are/is added thereto instead of element Ti, then a metal structure including a lot of Fe initial crystals will be produced even in the rapidly solidified alloy prepared by the strip casting process. Consequently, the desired metal structure cannot be obtained.

Also, in the melt spinning or strip casting process, the thickness of the resultant alloy is controllable by adjusting the surface velocity of the roller. If an alloy having a thickness of 70 μm to 300 μm is prepared by adjusting the surface velocity of the roller, then the alloy has the nanocrystalline structure described above, and can be easily divided into powder particles having various orientations through a pulverization process. As a result, powder particles having an isometric shape (i.e., having an aspect ratio close to one) can be obtained easily. That is to say, the powder particles obtained will not be elongated in a particular orientation but will have an isometric (or quasi-spherical) shape.

On the other hand, if the alloy is made thinner than 60 μm by increasing the surface velocity of the roller, then the metal structure of the alloy is easily divided perpendicularly to the roller contact surface as in the conventional rapidly solidified magnet. In that case, the powder particles obtained by the pulverization process are likely elongated parallelly to the surface of the alloy. As a result, powder particles having an aspect ratio of less than 0.3 are obtained often.

Description of Pulverization Process

Figure 7:
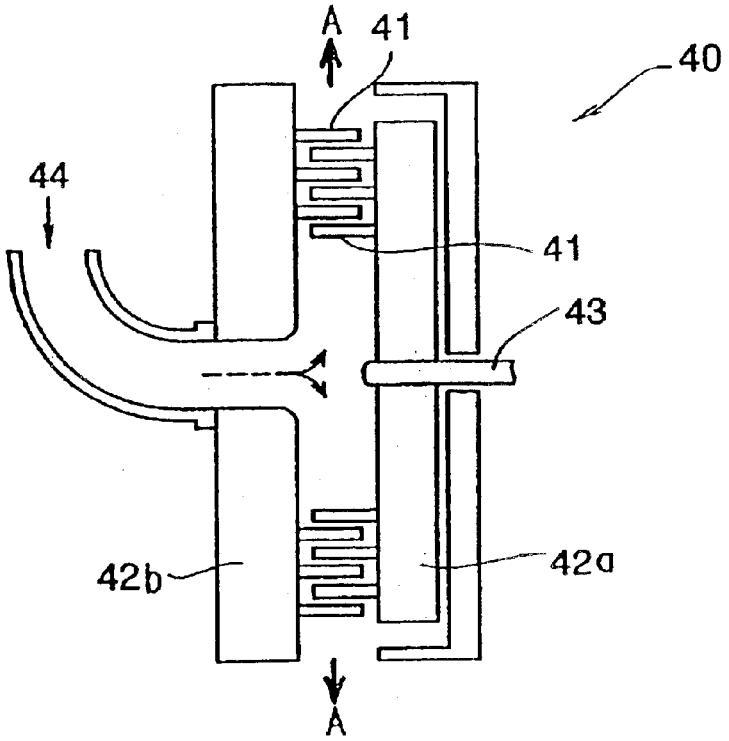
FIG. 7 is a view showing the configuration of a pin mill machine for use in the present invention.
Figure 8:
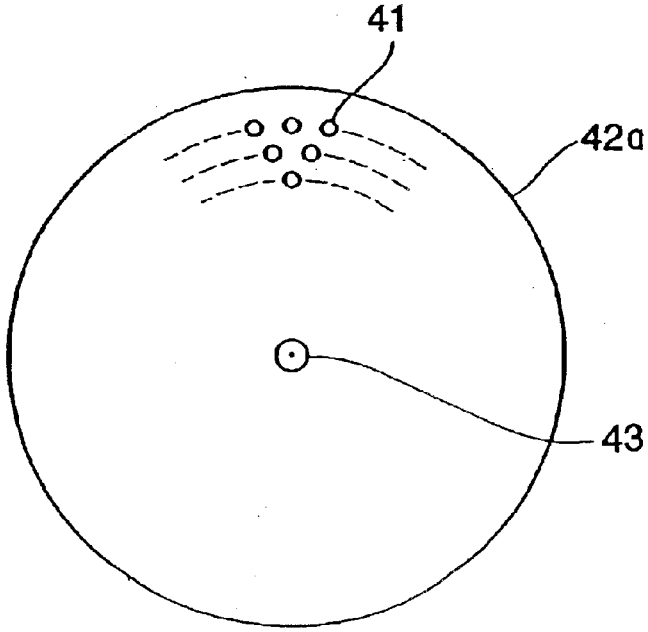
FIG. 8 is a view showing the arrangement of pins in the pin mill machine shown in FIG. 7.

The first iron-based rare-earth alloys described above (i.e., the first iron-based rare-earth alloy including no Ti and the first iron-based rare-earth alloy including Ti) may be pulverized by a pin disk mill such as that shown in FIG. 7, for example. FIG. 7 is a cross-sectional view illustrating an exemplary pin mill for use in this embodiment. The pin disk mill 40 includes two disks 42*a* and 42*b* that are arranged so as to face each other. On one side of each of these disks 42*a* and 42*b*, multiple pins 41 are arranged so as not to collide against each other. At least one of these disks 42*a* and 42*b* rotate(s) at a high velocity. In the example illustrated in FIG. 7, the disk 42*a*rotates around a shaft 43. FIG. 8 illustrates a front view of the disk 42*a* that is supposed to rotate. On the disk 42*a* shown in FIG. 8, the pins 41 are arranged to form a plurality of concentric circles. The pins 41 are also arranged in a similar concentric pattern on the fixed disk 42*b*.

A workpiece to be pulverized by the pin disk mill is loaded through an inlet port 44 into the space between the two disks, collides against the pins 41 on the rotating and fixed disks 42*a* and 42*b* and is pulverized due to the impact. A powder, formed by this pulverization, is blown off in the direction indicated by the arrows A and then collected to a predetermined position finally.

In the pin disk mill 40 of this embodiment, the disks 42*a* and 42*b*, supporting the pins 41 thereon, are made of a stainless steel, for example, while the pins 41 are made of a cemented carbide material such as sintered tungsten carbide (WC). Examples of other preferred cemented carbide materials include TiC, MoC, NbC, TaC and $Cr_3C_2$, not just the sintered WC. Each of these cemented carbide materials is a sintered body obtained by combining a carbide powder of a Group IVa, Va or VIa metal element with Fe, Co, Ni, Mo, Cu, Pb or Sn or an alloy thereof.

By carrying out the pulverization process using this pin mill machine under such conditions as to obtain a mean particle size of 10 μm to 70 μm, a powder that is made up of particles with aspect ratios of 0.4 to 1.0 can be obtained. If the mean particle size exceeds 70 μm, then the effect of increasing the flowability may not be achieved fully. However, if the mean particle size is smaller than 10 μm, then the powder will have an excessive surface area. In that case, the surface is easily oxidized to deteriorate the hard magnetic properties significantly or increase the risk of firing. In view of these considerations, the second iron-based rare-earth alloy powder preferably has a mean particle size of 10 μm to 70 μm, and more preferably 20 μm to 60 μm. The number of particles with sizes of 30 μm or less is preferably small.

There is a rough correlation between the mean particle size and the aspect ratio. Specifically, the more finely an alloy thin strip with a limited thickness is pulverized, the closer to 1.0 the aspect ratio goes. Also, the closer to 1.0 the aspect ratio, the more significantly the flowability is improved. Thus, the aspect ratio is more preferably 0.5 to 1.0, and even more preferably 0.6 to 1.0.

The pin mill machine that can be used effectively in the present invention is not limited to the pin disk mill in which pins are arranged on a disk, but may also be a machine in which pins are arranged on a cylinder, for example. Anyway, by using a pin mill machine, a powder having a particle size distribution that is close to a normal distribution can be obtained. In that case, the mean particle size can be adjusted easily and high mass-productivity is achieved advantageously.

In the pulverization process described above, the hammer mill that the applicant of the present application proposed in Japanese Patent Application No. 2001-105508 may also be used.

By mixing the first iron-based rare-earth alloy powder with no Ti (and/or Ti-containing first iron-based rare-earth alloy powder) obtained in this manner and the second iron-based rare-earth alloy powder at a volume ratio of 1:49 to 4:1, an iron-based rare-earth alloy powder that can be used to make a compound for a magnet can be obtained. By adopting a mixing ratio that falls within this range, an iron-based rare-earth alloy powder with well-balanced magnetic properties and flowability (which will be referred to herein as a "mixed magnet powder") can be obtained.

In view of possible variations in the magnetic properties and particle size distributions of the first iron-based rare-earth alloy powder with no Ti (and Ti-containing first iron-based rare-earth alloy powder) and the second iron-based rare-earth alloy powder at the time of mass production, the mixing ratio of the first and second iron-based rare-earth alloy powders is preferably 1:49 to 1:4. As long as the mixing ratio falls within this range, even if the magnetic properties and particle size distributions of the iron-based rare-earth alloy powders have deviated from optimum ranges, good enough magnetic properties and particle size distributions are still achievable with almost no problems caused in practice.

The mixing of the first iron-based rare-earth alloy powder with no Ti (and/or the Ti-containing first iron-based rare-earth alloy powder) and the second iron-based rare-earth alloy powder may be carried out by dry-mixing these powders together. In this dry-mixing process step, a lubricant or a dispersant may be added. Alternatively, these powders may also be mixed together in the process step of making a compound to be described below.

Description of Methods for Producing Compound and Magnet Body

The mixture of iron-based rare-earth alloy powders, or the mixture of the first and second iron-based rare-earth alloy powders, obtained as described above is compounded with a resin, thereby producing a compound to make a magnet. Typically, the mixture and the resin are compounded together with a kneader, for example. Optionally, in this compounding process step, a lubricant or a dispersant may also be added.

A compound to make a magnet may be molded by any of various molding methods and may be used in any of numerous applications. Thus, depending on the intended application, the type of the resin and the compounding ratio of the iron-based rare-earth alloy powder may be determined appropriately. Examples of usable resins include thermosetting resins such as epoxy and phenol resins and thermoplastic resins such as polyamides (including nylon 66, nylon 6 and nylon 12), PPS and liquid crystal polymers. Also, not just those resins but also rubbers or elastomers (including thermoplastic elastomers) may be used as well.

Examples of preferred forming techniques include compacting, rolling, extruding and injection molding. Among these forming techniques, the compound can be formed only in a relatively simple shape according to the compacting, rolling or extruding technique. In these techniques, however, the compound does not have to show so high a flowability during the forming process. Thus, the magnet powder can be included in the compound at a higher percentage. By using the magnet powder of the present invention, the magnet powder percentage can be increased to more than 80 vol %, for example, which is much higher than that achieved by a conventional technique. Also, the total volume of voids formed in the resultant compact can be reduced advantageously. In these forming methods, a thermosetting resin or a rubber is used exclusively.

The magnet powder of the present invention has good flowability, and can be used particularly effectively in a compound to be injection-molded. Also, the compound can be molded into a complex shape, which has been difficult to realize when a compound including the conventional rapidly solidified magnet powder is used. Furthermore, the magnet powder can be compounded at a higher percentage than the conventional compound, thus improving the magnetic properties of the resultant magnet body. Furthermore, the magnet powder of the present invention includes a rare-earth element at a relatively small mole fraction, and is not oxidized easily. For that reason, even if the compound is injection-molded at a relatively high temperature with a thermoplastic resin or thermoplastic elastomer having a relatively high softening point, the resultant magnetic properties will not deteriorate.

Furthermore, the magnet powder of the present invention includes the first iron-based rare-earth alloy powder that is not oxidized so easily. For that reason, the surface of the bonded magnet body as a final product does not always have to be coated with a resin film. Accordingly, if a component has a slot with a complex shape, for example, the compound of the present invention may be injection-molded into the slot. In this manner, a component, including a magnet in a complex shape as its integral part, can be obtained.

Description of Electric Appliance

The present invention is effectively applicable for use in an interior permanent magnet (IPM) type motor, for example. An IPM type motor according to a preferred embodiment includes a rotor core in which bonded magnets, including the magnet powder at a high density, are built in, and a stator that surrounds this rotor core. The rotor core includes a plurality of slots, in which the magnets of the present invention are located. These magnets are formed by melting the compound including the rare-earth alloy powder of the present invention, directly filling the slots of the rotor core with the compound, and molding it into the desired shape.

According to the present invention, the performance of the magnet-embedded rotor as disclosed in Japanese Laid-Open Publication No. 11-206075 mentioned above, for example, can be improved and/or the size thereof can be reduced. As shown in FIG. 3 of that publication, the rotor includes a plurality of crescent slots (with a width of about 2 mm, for example), into which a compound is injection-molded with a magnetic field applied thereto. The compound including the conventional rapidly solidified magnet powder has low flowability, and therefore, the magnet powder percentage thereof may be limited to a low value. Or due to the low flowability, the compound sometimes cannot fill the slots fully or may have a non-uniform magnet powder distribution. However, all of these problems can be solved by using the compound of the present invention, thus providing a small-sized, high-performance IPM type motor. Furthermore, the molding time can also be shortened and the productivity can be increased advantageously.

The magnets of the present invention can be used effectively in not just motors of this type but also various types of electric appliances including other types of motors and actuators.

Hereinafter, specific examples of the present invention will be described.

EXAMPLE 1

A method of making the first iron-based rare-earth alloy powder (with no Ti) of the present invention will be described as a first specific example.

For each of Examples Nos. 1 through 5, Fe, Co, B, Nd and Pr with purities of 99.5% or more were weighed so that the mixture had a total weight of 100 g and then the mixture was put into a crucible of quartz. Examples Nos. 1 through 5 had the compositions shown in Table 1. The quartz crucible had an orifice with a diameter of 0.8 mm at the bottom. Accordingly, the material was melted in the quartz crucible to be a molten alloy, which was then ejected downward through the orifice. The material was melted by a high frequency heating method within an argon atmosphere at a pressure of 2 kPa. In this specific example, the melting temperature was set to 1,350° C.

The surface of the molten alloy was pressurized at 32 kPa, thereby ejecting the melt against the outer circumference of a copper chill roller, which was located 0.8 mm under the orifice. The roller was rotated at a high velocity while being cooled inside so that the outer circumference would have its temperature kept at around room temperature. Accordingly, the molten alloy, which had been dripped down through the orifice, contacted with the surface of the chill roller to have its heat dissipated therefrom while being forced to rapidly move in the peripheral velocity direction. The molten alloy was continuously expelled through the orifice onto the surface of the roller. Thus, the rapidly cooled and solidified alloy was in the shape of an elongated thin strip (or ribbon) with a width of 2 mm to 5 mm and a thickness of 70 μm to 300 μm.

In the rotating roller (e.g., single roller) method adopted in this specific example, the cooling rate is defined by the roller peripheral velocity and the weight of the melt dripped per unit time, which depends on the diameter (or cross-sectional area) of the orifice and the pressure on the melt. In the present examples, the orifice had a diameter of 0.8 mm, the melt ejecting pressure was 30 kPa and the dripping rate was about 0.1 kg/s. Also, in the present examples, the roller surface peripheral velocity Vs was in the range of 2 m/s to 12 m/s. The resultant rapidly solidified alloy thin strip had a thickness of 85 μm to 272 μm.

To obtain a rapidly solidified alloy including amorphous phases, the cooling rate is preferably at least $10^{3}$° C./s. And to achieve a cooling rate falling within this range, the roller peripheral velocity is preferably defined at least at 2 m/s.

Figure 9:
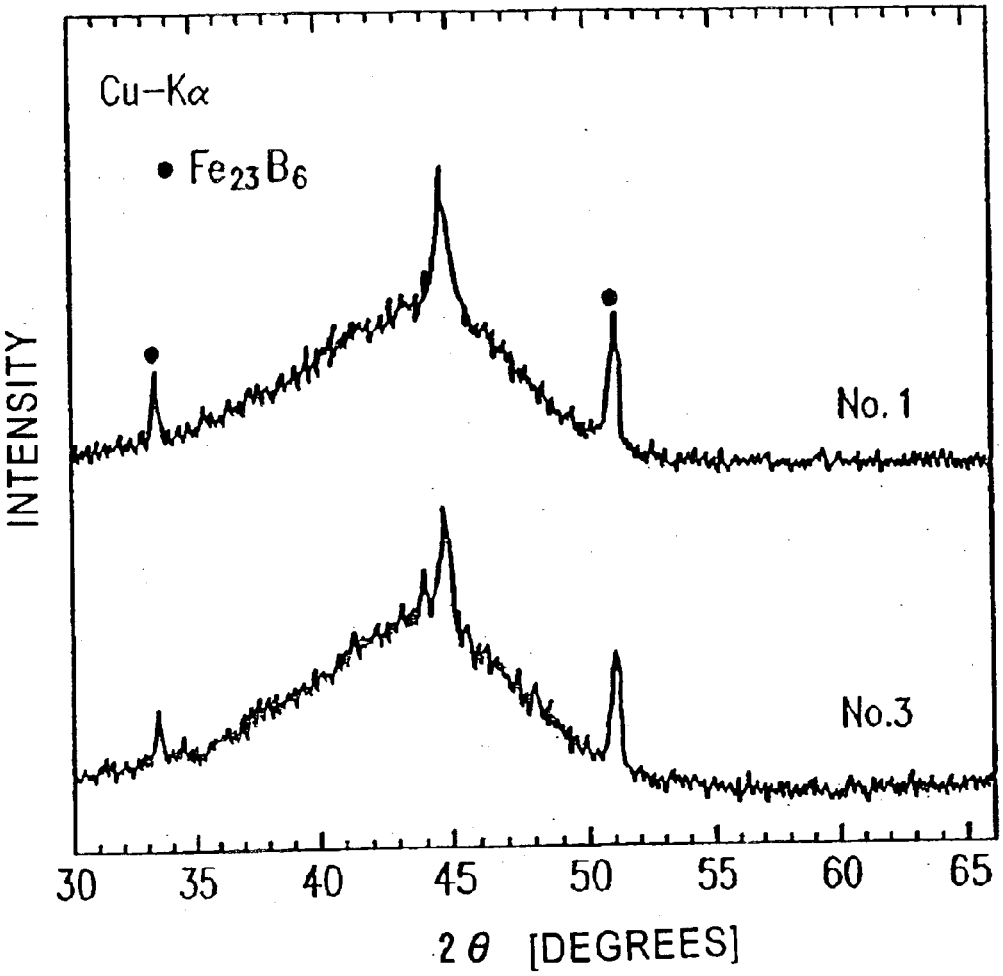
FIG. 9 is a graph showing powder X-ray diffraction patterns for specific examples of the present invention.

The rapidly solidified alloy thin strips obtained in this manner were analyzed with a CuKα characteristic X-ray. FIG. 9 shows the powder X-ray diffraction patterns of Examples Nos. 1 and 3. As can be seen from FIG. 9, the rapidly solidified alloys representing Examples Nos. 1 and 3 have a metal structure including an amorphous structure and $Fe_{23}B_6$.

TABLE 1

| Sample | Alloy composition (at %) | | | | Roller Surface Velocity Vs | Heat Treatment Temperature | Alloy Thickness |
|---|---|---|---|---|---|---|---|
| No. | R | Fe | B | M | (m/s) | (° C.) | (μ m) |
| EXAMPLES | | | | | | | |
| 1 | Nd4 | Balance | 18.5 | — | 8 | 640 | 144 |
| 2 | Nd4.5 | Balance | 17.0 | Co1 | 2 | 650 | 255 |
| 3 | Nd5.5 | Balance | 19.0 | Co5 + Cr5 | 6 | 680 | 170 |
| 4 | Nd2.5 + Pr2 | Balance | 16.0 | Co3 + Ga1 | 9 | 630 | 120 |
| 5 | Nd3.5 + Dy1 | Balance | 18.5 | Co3 + Si1 | 7 | 640 | 150 |
| COMP | | | | | | | |
| 6 | Nd3 | Balance | 18.5 | — | 15 | 620 | 61 |
| 7 | Nd4.5 | Balance | 17.0 | Co1 | 20 | 650 | 30 |
| 8 | Nd3.5 + Dy1 | Balance | 18.5 | Co3 + Si1 | 30 | 640 | 22 |

In Table 1, the column "R" includes "Nd5.5", for example, which means that 5.5 at % of Nd was added as a rare-earth element. Also, the column "R" includes "Nd2.5+Pr2", for example, which means that 2.5 at % of Nd and 2 at % of Pr were added as rare-earth elements.

Next, each of the resultant rapidly solidified alloy thin strips was coarsely pulverized to obtain a powder having a mean particle size of 850 μm or less. Thereafter, the powder was thermally treated at the temperature shown in Table 1 for 10 minutes within an argon atmosphere. Then, the coarsely pulverized powder was further pulverized to 150 μm or less by a disk mill machine, thereby obtaining an iron-based rare-earth alloy powder (or magnet powder) according to the present invention. The following Table 2 shows the magnetic properties of the magnet powders obtained in this manner and the aspect ratios of powder particles having particle sizes of 40 μm or more. The aspect ratios were calculated from the major-axis and minor-axis sizes of respective particles that had been obtained by SEM observation.

TABLE 2

| Sample | Magnetic properties of first iron-based rare-earth alloy powder | | | Aspect |
|---|---|---|---|---|
| No. | $B_r$ (T) | $H_{cJ}$ (kA/m) | $(BH)_{max}$ (kJ/m$^3$) | Ratio |
| EXAM | | | | |
| 1 | 1.08 | 265 | 82 | 0.58 |
| 2 | 1.11 | 300 | 95 | 0.83 |
| 3 | 0.79 | 610 | 72 | 0.92 |
| 4 | 1.20 | 310 | 98 | 0.44 |
| 5 | 1.15 | 360 | 102 | 0.75 |
| COM | | | | |
| 6 | 1.21 | 250 | 72 | 0.21 |
| 7 | 1.09 | 305 | 89 | 0.14 |
| 8 | 1.14 | 358 | 98 | 0.08 |

As can be seen from Table 2, the magnet powders representing Examples Nos. 1 through 5 had aspect ratios of 0.4 to 1.0, and also exhibited excellent magnetic properties.

Thus, those magnet powders are characterized by having higher remanence $B_r$ than the conventional MQ powder.

COMPARATIVE EXAMPLES

Comparative Examples Nos. 6 through 8 shown in Table 1 were obtained by performing almost the same process steps as those described for the specific examples of the present invention. The difference from the specific examples was that in rapidly cooling a molten alloy, the roller surface peripheral velocity was adjusted in the comparative examples to somewhere between 15 m/s and 30 m/s, thereby obtaining a rapidly solidified alloy thin strip with a thickness of 20 μm to 65 μm.

The magnetic properties and aspect ratios of magnet powders representing the comparative examples are also shown in Table 2. As can be seen from Table 2, the comparative examples had aspect ratios that were less than 0.3.

Figure 10:
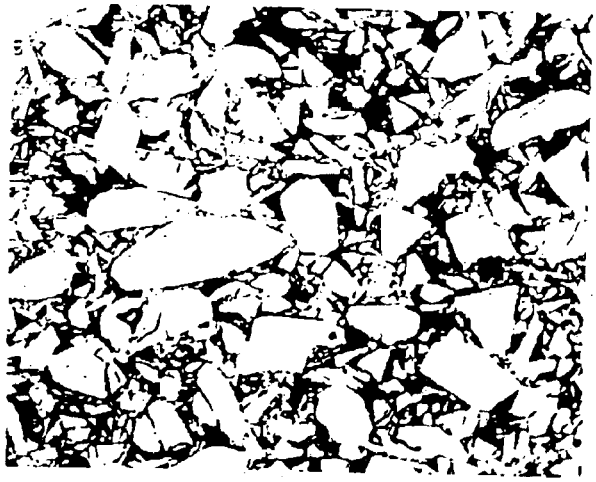
FIG. 10 is a sectional SEM photograph of a bonded magnet according to the present invention.
Figure 11:
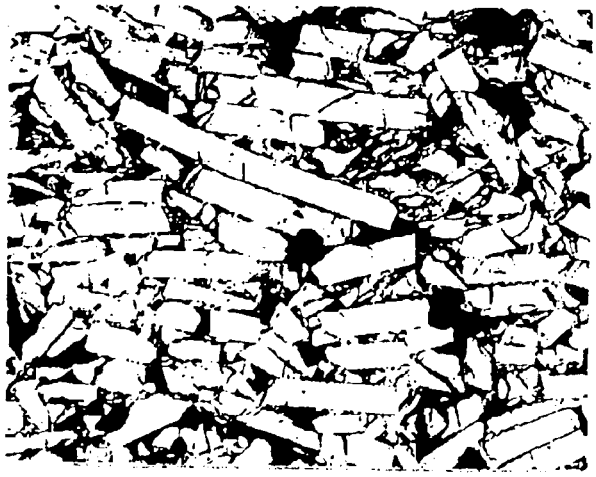
FIG. 11 is a sectional SEM photograph of a bonded magnet representing a comparative example.

FIG. 10 is a sectional SEM photograph of a bonded magnet that was obtained by compacting a compound including only the first iron-based rare-earth alloy powder (with no Ti) of the present invention (with 2 mass % of epoxy resin). On the other hand, FIG. 11 is a sectional SEM photograph (at a magnification of 100) of a bonded magnet that was obtained by compacting a compound including only the MQP-B powder (produced by MQI, Inc.) with 2 mass % of epoxy resin (i.e., a comparative example). In the first iron-based rare-earth alloy powder of the present invention, at least 60 mass % of powder particles with particle sizes of 40 μm or more have aspect ratios of 0.3 or more. On the other hand, in the conventional rapidly solidified alloy powder representing the comparative example, some of powder particles with particle sizes of 0.5 μm or less may have aspect ratios of 0.3 or more but most of the powder particles with particle sizes of 40 μm or more have aspect ratios that are less than 0.3.

EXAMPLE 2

In a second specific example of the present invention to be described below, a bonded magnet was formed by an injection molding process.

First, the first iron-based rare-earth alloy powder (with no Ti) was prepared in the following manner.

A material alloy, obtained by mixing respective materials so as to have an alloy composition $Nd_{4.5}Fe_{73.0}B_{18.5}Co_2Cr_2$, was melted by a high frequency heating process. Then, the resultant molten alloy was teemed at a feeding rate of 5 kg/min onto the surface of a copper roller, which was rotating at a roller surface peripheral velocity of 8 m/s, by way of a shoot. In this manner, a rapidly solidified alloy thin strip with a thickness of 120 μm was obtained. This rapidly solidified alloy had a structure in which $Fe_{23}B_6$ and amorphous phases coexisted.

Next, the resultant rapidly solidified alloy was coarsely pulverized to 1 mm or less, which was then thermally treated at 700° C. for 15 minutes within an argon gas. In this manner, a nanocomposite magnet, in which an $Fe_3B$ phase having nanometer-scale crystal grain sizes (with an average crystal grain size of about 20 nm) and an $Nd_2Fe_{14}B$ phase coexisted in the same structure, was obtained. Thereafter, this nanocomposite magnet was further pulverized to obtain a first iron-based rare-earth alloy powder having the particle sizes shown in the following Table 3. This first iron-based rare-earth alloy powder had particle sizes of at most 53 μm, a mean particle size of 38 μm or less, and aspect ratios of 0.6 to 1.0. Also, the first iron-based rare-earth alloy powder used in this example had magnetic properties including $B_r$ of 0.95 T, $H_{cJ}$ of 380 kA/m and $(BH)_{max}$ of 82 kJ/m$^3$.

On the other hand, MQP-B and MQP 15-7 produced by MQI Inc. (which will be referred to herein as "MQ powders" collectively) were used as the second iron-based rare-earth alloy powders (i.e., conventional rapidly solidified alloy powders). These MQ powders obtained were pulverized with a power mill and then classified, thereby adjusting the particle size distributions of the MQ powders appropriately. The particle size distribution of a typical MQ powder is also shown in Table 3. The MQP-B powder used in this example had magnetic properties including $B_r$ of 0.88 T, $H_{cJ}$ of 750 kA/m and $(BH)_{max}$ of 115 kJ/m$^3$. The MQP 15-7 powder had magnetic properties including $B_r$ of 0.95 T, $H_{cJ}$ of 610 kA/m and $(BH)_{max}$ of 130 kJ/m$^3$.

Table 3 also shows the particle size distribution of a magnet powder that was obtained by mixing the first iron-based rare-earth alloy powder and the MQ powder together at 1:1. The MQ powder shown in Table 3 had a mean particle size of 100 μm, while the mixed magnet powder had a mean particle size of 60 μm. The first and second iron-based rare-earth alloy powders both had a true density of about 7.5 g/cm$^3$.

TABLE 3

| Particle Size | First iron-based rare-earth alloy powder | MQ Powder | 1:1 mixture |
|---|---|---|---|
| <38 | 60.4 | 6.4 | 26.2 |
| 38–53 | 39.6 | 6.0 | 20.0 |
| 53–75 | 0.0 | 14.8 | 13.7 |
| 75–106 | 0.0 | 26.7 | 13.0 |
| 106–125 | 0.0 | 14.9 | 7.6 |
| 125–150 | 0.0 | 15.4 | 9.1 |
| 150–180 | 0.0 | 10.8 | 7.0 |
| 180–212 | 0.0 | 4.5 | 3.2 |
| 212–250 | 0.0 | 0.4 | 0.3 |
| 250–300 | 0.0 | 0.1 | 0.1 |

Also, the first iron-based rare-earth alloy powder and various MQ powders were mixed together at the mixing ratios (ranging from 1:19 to 7:3) shown in the following Table 4 to obtain respective magnet powders. Then, the magnet powders and nylon 66 were compounded together at absolute specific gravities of 7.5 g/cm$^3$ and 1.1 g/cm$^3$, respectively, thereby obtaining a compound to be injection-molded with a specific gravity of 5 g/cm$^3$. In Table 4, Samples Nos. 11 through 17 represent specific examples of the present invention and Samples Nos. 18 through 22 represent comparative examples.

The melt flow rates (which will be abbreviated herein as "MFR") of the compounds representing respective specific examples and comparative examples were evaluated as indices to their flowability by using a melt indexer. The evaluation conditions included a nozzle diameter of 2.095 mm, an extrusion load of 5 kgf/cm$^3$, and melting temperatures of 240° C., 260° C. and 280° C.

TABLE 4

| Sample No. | Mixing ratio (mass %) MQ Powder | First iron-based rare-earth alloy powder | Particle size (μ m) MQ powder | First iron-based rare-earth alloy powder |
|---|---|---|---|---|
| EXAMPLE | | | | |
| 11 | MQP-B 70 | 30 | <150 | <53 |
| 12 | MQP-B 70 | 30 | <300 | <53 |
| 13 | MQP-B 50 | 50 | <300 | <53 |
| 14 | MQP-B 30 | 70 | <300 | <53 |
| 15 | MQP 15-7 70 | 30 | <300 | <53 |
| 16 | MQP 15-7 50 | 50 | <300 | <53 |
| 17 | MQP 15-7 30 | 70 | <300 | <53 |
| COMP | | | | |
| 18 | MQP-B 100 | 0 | <300 | |
| 19 | MQP-B 100 | 0 | <150 | |
| 20 | MQP 15-7 100 | 0 | <150 | |
| 21 | MQP-B 50 | 50 | <300 | <150 |
| 22 | MQP 15-7 50 | 50 | <150 | <150 |

TABLE 5

| Sample No. | MFR (g/10 min.) 240° C. | 260° C. | 280° C. |
|---|---|---|---|
| EXAMPLE | | | |
| 11 | 137 | 234 | 329 |
| 12 | 118 | 205 | 283 |
| 13 | 132 | 209 | 291 |
| 14 | 129 | 211 | 286 |
| 15 | 148 | 221 | 337 |
| 16 | 124 | 204 | 305 |
| 17 | 119 | 208 | 292 |
| COMP | | | |
| 18 | 46 | 59 | 82 |
| 19 | 75 | 126 | 233 |
| 20 | 93 | 175 | 247 |
| 21 | No flow | 72 | 145 |
| 22 | No flow | 83 | 165 |

As can be seen from the results shown in Table 5, the compounds that were prepared with the magnet powder of the present invention exhibited higher flowability than the compound of the comparative examples at any melting temperature.

Next, the compounds representing Examples Nos. 11 and 13 were injection-molded at an injection temperature of 260° C., thereby obtaining bonded magnets having a flat and elongated shape and cross-sectional sizes of 2 mm×10 mm and a height (or depth) of 60 mm. This shape was adopted to replicate the slot shape of a rotor for use in the IPM-type motor described above. No matter whether the compound representing Example No. 11 or the compound representing Example No. 13 was used, the compound could be fully injected into the cavity of the die, and a bonded magnet in a good shape could be obtained.

Each of these bonded magnets was equally divided into three in the cavity depth direction to obtain three magnet pieces with dimensions of 2 mm×10 mm×20 mm. These three magnet pieces will be referred to herein as "magnet pieces A, B and C", which are the closest to, the next closest to, and the least close to, the injection molding gate, respectively. A pulsed magnetic field of 3.2 MA/m was applied to these magnet pieces parallel to the shorter side (i.e., the 2 mm side) thereof, thereby magnetizing them. Thereafter, the magnetic properties thereof were measured with a BH tracer. The results are shown in the following Table 6.

TABLE 6

| Sample No. | Magnetic properties $B_r$ (T) | $H_{cJ}$ (kA/m) | $(BH)_{max}$ (kJ/m$^3$) |
|---|---|---|---|
| EXAMP | | | |
| 11-A | 0.56 | 648 | 40.3 |
| 11-B | 0.56 | 641 | 40.7 |
| 11-C | 0.56 | 650 | 39.5 |
| 13-A | 0.57 | 503 | 36.8 |
| 13-B | 0.57 | 501 | 36.5 |
| 13-C | 0.57 | 498 | 36.3 |
| COMP | | | |
| 18-A | 0.54 | 727 | 47.4 |
| 18-B | 0.53 | 723 | 45.1 |
| 18-C | 0.44 | 719 | 33.8 |
| 21-A | 0.55 | 547 | 36.3 |
| 21-B | 0.53 | 551 | 32.2 |
| 21-C | 0.48 | 538 | 27.8 |

As is clear from the results shown in Table 6, the bonded magnets representing specific examples of the present invention exhibited stabilized magnetic properties, no matter how distant from the gate they were. In the bonded magnets representing the comparative examples on the other hand, the more distant from the gate, the more significantly the maximum energy products thereof, in particular, decreased. These results also prove the high flowability of the magnet compound of the present invention definitely. Consequently, even in a situation where a bonded magnet is hard to form with the conventional magnet compound, a bonded magnet with uniform magnetic properties can also be obtained.

EXAMPLE 3

In this specific example, the best mixing ratio of the first and second rare-earth alloy powders was looked for to increase the mass-productivity of bonded magnets.

A nanocomposite magnet powder having the same composition as the second specific example described above was used as the first iron-based rare-earth alloy powder. However, since some variations in magnetic properties were naturally expected from mass-produced ones, the nanocomposite magnet powder used had relatively low magnetic properties including $B_r$ of 0.92 T, $H_{cJ}$ of 370 kA/m and $(BH)_{max}$ of 73 kJ/m$^3$. This magnet powder had particle sizes of 53 μm or less, a mean particle size of 38 μm or less, and an aspect ratio of 0.88.

Also, MQP 15-7 was used as the second iron-based rare-earth alloy powder. In the second example described above, the particle size distribution was adjusted to a mean particle size of 100 μm by classifying the MQP 15-7 powder. In this specific example on the other hand, the MQP 15-7 powder prepared (with a mean particle size of 150 μm) was used as it was, except that only particles with very large sizes of 300 μm or more were removed.

Magnet powders were obtained as Samples Nos. 23 through 28 by mixing the first and second iron-based rare-earth alloy powders at the mixing ratios (ranging from 1:49 to 1:1) shown in the following Table 7. In the comparative example as represented by Sample No. 29, only the MQP 15-7 powder was used.

TABLE 7

| Sample No. | Mixing ratio (mass %) MQP 15-7 | First iron-based rare-earth alloy powder |
|---|---|---|
| Example | | |
| 23 | 98 | 2 |
| 24 | 95 | 5 |
| 25 | 90 | 10 |
| 26 | 80 | 20 |
| 27 | 70 | 30 |
| 28 | 50 | 50 |
| Comparative Example | | |
| 29 | 100 | 0 |

There, as in the second specific example described above powders Nos. 23 through 29 and nylon 66 were compounded together at absolute specific gravities of 7.5 g/cm$^3$ and 1.1 g/cm$^3$, respectively, thereby obtaining a compound with an absolute specific gravity of 4.9 g/cm$^3$.

The MFRs of these compounds at respective melting temperature of 240° C., 260° C. and 275° C. were evaluated as in the second specific example described above. The results are shown in the following Table 8. As is clear from Table 8, each of Samples Nos. 23 through 28 representing specific examples of the present invention had a higher MFR value than Sample No. 29 representing the comparative example at any melting temperature. Thus, it can be seen that the flowability was increased by mixing the first iron-based rare-earth alloy powder. However once the mass percentage of the first iron-based rare-earth alloy powder exceeded 20 mass %, the MFR value tended to decrease. Accordingly, if the MQP 15-7 powder is used without adjusting the particle size distribution thereof, the mass percentage of the first iron-based rare-earth alloy powder is preferably defined at 20 mass % or less. Naturally, there should be some variation in the particle size distribution of the MQP 15-7 powder among respective lots. Thus, even if the first iron-based rare-earth alloy powder is mixed at 20 mass % or more, the flowability may still be increased. However, to make the production easily controllable and to increase the mass-productivity, the mass percentage of the first iron-based rare-earth alloy powder is preferably decreased to 20 mass % or less.

TABLE 8

| Sample No. | MFR (g/10 min.) 240° C. | 260° C. | 275° C. |
|---|---|---|---|
| Example | | | |
| 23 | 75.3 | 140.6 | 225.2 |
| 24 | 114.2 | 193.7 | 316.4 |
| 25 | 136.0 | 218.5 | 366.8 |
| 26 | 152.0 | 255.7 | 360.9 |
| 27 | 128.1 | 208.6 | 342.9 |
| 28 | 112.9 | 162.7 | 270.4 |
| Comparative Example | | | |
| 29 | 68.7 | 116.1 | 190.6 |

Next, the respective compounds were injection-molded into bonded magnets as in the second specific example described above, and the magnetic properties thereof were evaluated. The results are shown in the following Table 9.

TABLE 9

| Sample No. | Magnetic properties $B_r$ (T) | $H_{cJ}$ (kA/m) | $(BH)_{max}$ (kJ/m$^3$) |
|---|---|---|---|
| Example | | | |
| 23 | 0.43 | 592 | 27.2 |
| 24 | 0.42 | 594 | 24.3 |
| 25 | 0.41 | 586 | 25.4 |
| 26 | 0.40 | 586 | 23.9 |
| 27 | 0.39 | 541 | 22.3 |
| 28 | 0.36 | 480 | 18.0 |
| Comparative Example | | | |
| 29 | 0.43 | 586 | 28.5 |

As can be seen from Table 9, the magnetic properties gradually decreased as the mass percentage of the first iron-based rare-earth alloy powder increased. This is believed to be because the first iron-based rare-earth alloy powder used in this specific example had bad magnetic properties in Br and loop squareness, in particular. Nevertheless, Samples Nos. 23 through 25, including the first iron-based rare-earth alloy powder at mass percentages not exceeding 20 mass %, exhibited magnetic properties that were good enough to cause almost no problems in practice. Thus, the mass percentage of the first iron-based rare-earth alloy powder is also preferably controlled to no greater than 20 mass % because the resultant flowability would also be high in that case as described above. Also, as in the second specific example described above, each of the bonded magnets Nos. 23 through 27 of the present example exhibited the magnetic properties shown in Table 9, no matter how distant from the injection molding gate it was.

As described above by way of the first, second and third illustrative examples, by adjusting the magnetic properties, particle size distributions and aspect ratios of the first and second iron-based rare-earth alloy powders, the present invention provided compounds that maintained practical magnetic properties and exhibited increased flowability in a wide mixing ratio range (i.e., when the mixing ratio of the first and second iron-based rare-earth alloy powders was in the range of 1:49 to 7:3). Furthermore, if the magnetic properties and particle size distributions of the first and second rare-earth alloy powders are optimized, the mixing ratio could be increased up to 4:1. Naturally, in a compound including the magnet powder at a low percentage, the mass percentage of the first iron-based rare-earth alloy powder can be further increased. To achieve sufficient mass-productivity, the mass percentage of the first iron-based rare-earth alloy powder is preferably controlled at 20 mass % (at a mixing ratio of 1:4) or less.

EXAMPLE 4

A material, which had been mixed to have an alloy composition including 9 at % of Nd, 11 at % of B, 3 at % of Ti, 2 at % of Co and Fe as the balance and a weight of about 5 kg, was introduced into a crucible and then inductively heated by a high frequency heating technique within an Ar atmosphere having a pressure maintained at 50 kPa, thereby obtaining a molten alloy.

The crucible was tilted to directly feed the molten alloy onto a pure copper chill roller, having a diameter of 250 mm and rotating at a roller surface peripheral velocity of 15 m/s, by way of a shoot, thereby rapidly cooling and solidifying the molten alloy. In feeding the melt onto the roller, the melt feeding rate was controlled to 3 kg/min by adjusting the tilt angle of the crucible.

As for the rapidly solidified alloys obtained in this manner, the thicknesses of 100 flakes were measured with a micro meter. As a result, the rapidly solidified alloys had an average thickness of 70 μm with a standard deviation σ of 13 μm. Thereafter, the rapidly solidified alloy that had been obtained in this manner was pulverized to a size of 850 μm or less and then was loaded at a feeding rate of 20 g/min into a hoop belt furnace, running at a belt feeding speed of 100 mm/min and having a soaking zone with a length of 500 mm, within an argon atmosphere that had a temperature retained at 680° C. In this manner, the powder was thermally treated to obtain a magnet powder.

Figure 12:
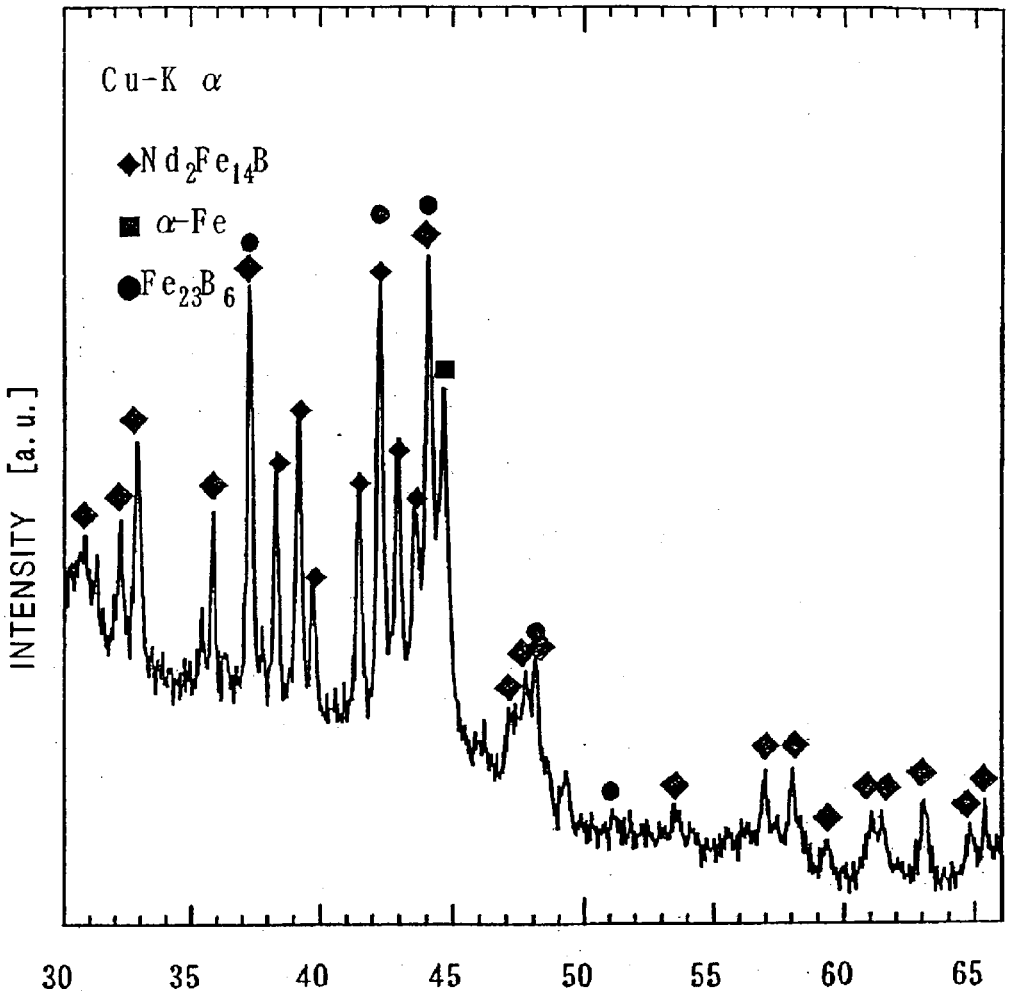
FIG. 12 is a graph showing the X-ray diffraction pattern of a first iron-based rare-earth alloy powder containing Ti in a fourth specific example of the present invention.

It was confirmed by a powder X-ray diffraction analysis that the magnet powder obtained had a nanocomposite structure. FIG. 12 shows the X-ray diffraction pattern obtained. As can be seen from FIG. 12, $Nd_2Fe_{14}B$ phase, $Fe_{23}B_6$ phase and α-Fe phase were identified.

Next, the resultant magnet powder was pulverized with a pin disk mill as already described with reference to FIGS. 7 and 8, thereby obtaining a powder with aspect ratios of 0.4 to 1.0. The aspect ratios were obtained by SEM observation.

Figure 13:
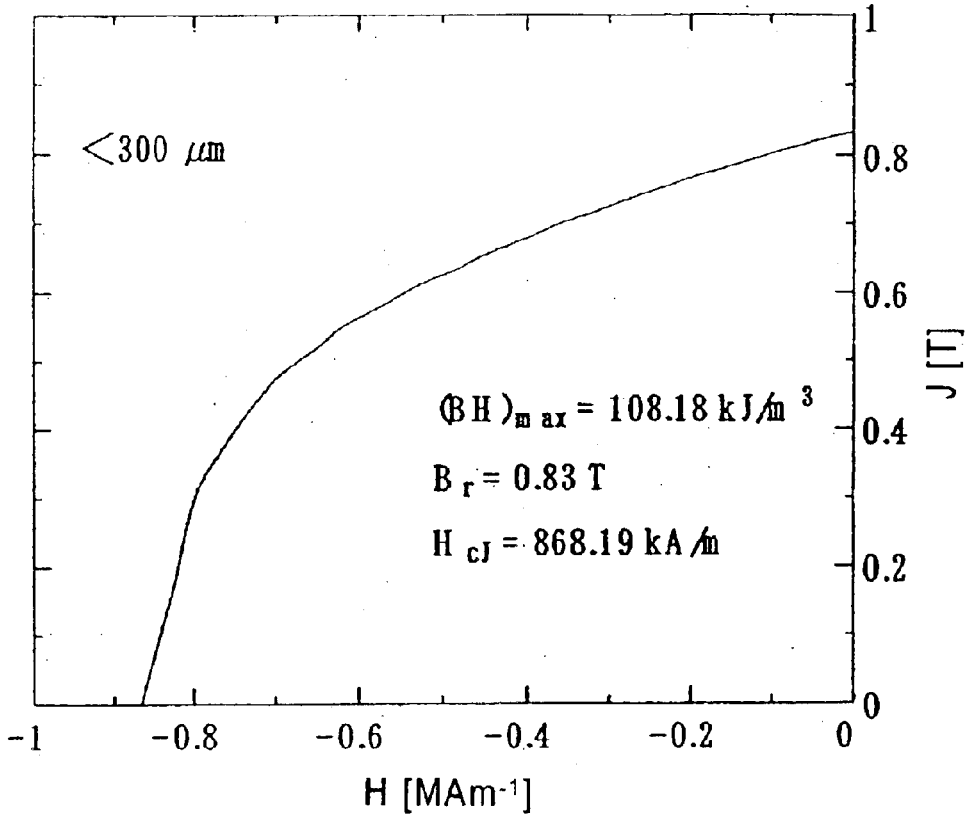
FIG. 13 is a graph showing a magnetic property of the first iron-based rare-earth alloy powder containing Ti in the fourth specific example of the present invention.

The particle size distribution and magnetic properties of the Ti-containing first iron-based rare-earth alloy powder of the fourth specific example are shown in the following Table 10. Also, FIG. 13 shows a magnetic property of this magnet powder. As can be seen from Table 10 and FIG. 13, the Ti-containing first iron-based rare-earth alloy of the fourth specific example has excellent magnetic properties and exhibits light particle size dependence. Accordingly, if the rare-earth alloy powder is classified with a standard sieve JIS8801 so as to obtain the desired particle size distribution and then mixed with the second iron-based rare-earth alloy powder, a bonded magnet having even better magnetic properties than the first, second or third specific example described above can be obtained.

TABLE 10

| Particle | Fourth example | | | |
|---|---|---|---|---|
| Size (μm) | (mass %) | $(BH)_{max}$ (kJ/m³) | $H_{cJ}$ (kA/m) | $B_r$ (T) |
| ≦38 | 9.36 | 104.5 | 854.66 | 0.830 |
| 38<, ≦53 | 6.83 | 104.77 | 844.00 | 0.829 |
| 53<, ≦75 | 12.34 | 107.16 | 853.39 | 0.831 |
| 75<, ≦106 | 19.76 | 110.67 | 859.75 | 0.837 |
| 106<, ≦125 | 12.23 | 112.64 | 866.12 | 0.845 |
| 125<, ≦150 | 15.24 | 111.63 | 864.21 | 0.843 |
| 150<, ≦180 | 9.42 | 105.64 | 896.30 | 0.820 |
| 180<, ≦212 | 8.89 | 107.61 | 849.41 | 0.831 |
| 212<, ≦250 | 4.27 | 99.67 | 851.16 | 0.814 |
| 250< | 1.65 | 88.44 | 844.64 | 0.800 |

According to the present invention, an iron-based rare-earth alloy powder and a magnet compound, which can exhibit increased packability and flowability during a compaction process, can be obtained. By using such an iron-based rare-earth alloy powder, a bonded magnet with an increased magnet powder percentage and an electric appliance including such a bonded magnet are provided.

Particularly, the present invention provides a magnet compound which can be injection-molded into a complex shape. Thus, an electric appliance such as an ipm type motor can have its size reduced and its performance improved.

What is claimed is:

1. An iron-based rare-earth alloy powder comprising:

a first iron-based rare-earth alloy powder, which has a mean particle size of 10 μm to 70 μm and of which the powder particles have aspect ratios of 0.4 to 1.0; and a second iron-based rare-earth alloy powder, which has a mean particle size of 70 μm to 300 μm and of which the powder particles have aspect ratios of less than 0.3, wherein the first and second iron-based rare-earth alloy powders are mixed at a volume ratio of 1:49 to 4:1.

2. The iron-based rare-earth alloy powder of claim 1, wherein the first iron-based rare-earth alloy powder has a composition represented by the general formula:

$$(Fe_{1-m}T_m)_{100-x-y-z}Q_xR_yM_z$$

where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb; and the mole fractions x, y, and z satisfy the inequalities of: 10 at %≦x≦30 at %; 2 at %≦y<10 at %; 0 at %≦z≦10 at %; and 0≦m≦0.5, respectively.

3. The iron-based rare-earth alloy powder of claim 2, wherein the first iron-based rare-earth alloy powder includes, as its constituent phases, an Fe phase, an FeB compound phase and a compound phase having an $R_2Fe_{14}B$ crystalline structure, and the respective constituent phases have an average crystal grain size of 150 nm or less.

4. The iron-based rare-earth alloy powder of claim 1, wherein the first iron-based rare-earth alloy powder has a composition represented by the general formula:

$$(Fe_{1-m}T_m)_{100-x-y-z}Q_xR_yM_z$$

where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb and always includes Ti; and the mole fractions x, y, z and m satisfy the inequalities of: 10 at %<x≦20 at %; 6 at %<y<10 at %; 0.1 at %≦z≦12 at %; and 0≦m≦0.5, respectively.

5. The iron-based rare-earth alloy powder of claim 4, wherein the first iron-based rare-earth alloy powder includes at least two ferromagnetic crystalline phases, of which hard magnetic phases have an average crystal grain size of 5 nm to 200 nm and soft magnetic phases have an average crystal grain size of 1 nm to 100 nm.

6. The iron-based rare-earth alloy powder of claim 1, wherein the second iron-based rare-earth alloy powder has a composition represented by the general formula:

$$Fe_{100-x-y}Q_xR_y$$

where Fe is iron; Q is at least one element selected from the group consisting of B and C and always includes B; R is at least one rare-earth element selected from the group consisting of Pr, Nd, Dy and Tb; and the mole fractions x and y satisfy the inequalities of 1 at %≦x≦6 at % and 10 at %≦y≦25 at %, respectively.

7. A compound for use to make a magnet, the compound comprising the iron-based rare-earth alloy powder of claim 1 and a resin.

8. The compound of claim 7, wherein the resin is a thermoplastic resin.

9. A permanent magnet made of the compound of claim 7.

10. The permanent magnet of claim 9, wherein the permanent magnet has a density of at least 4.5 g/cm$^3$.

11. A motor comprising:

a rotor including the permanent magnet of claim 9; and a stator, which is provided so as to surround the rotor.

12. A method of making an iron-based rare-earth alloy powder, the method comprising the steps of:

(a) providing a first iron-based rare-earth alloy powder, which has a mean particle size of 10 μm to 70 μm and of which the powder particles have aspect ratios of 0.4 to 1.0;

(b) providing a second iron-based rare-earth alloy powder, which has a mean particle size of 70 μm to 300 μm and of which the powder particles have aspect ratios of less than 0.3; and (c) mixing the first and second iron-based rare-earth alloy powders at a volume ratio of 1:49 to 4:1.

13. The method of claim 12, wherein the first iron-based rare-earth alloy powder has a composition represented by the general formula:

$$(Fe_{1-m}T_m)_{100-x-y-z}Q_xR_yM_z$$

where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb; and the mole fractions x, y, and z satisfy the inequalities of: 10 at %≦x≦30 at %; 2 at %≦y<10 at %; 0 at %≦z≦10 at %; and 0≦m≦0.5, respectively.

14. The method of claim 12, wherein the first iron-based rare-earth alloy powder has a composition represented by the general formula:

$$(Fe_{1-m}T_m)_{100-x-y-z}Q_xR_yM_z$$

where T is at least one element selected from the group consisting of Co and Ni; Q is at least one element selected from the group consisting of B and C and always includes B; R is at least one rare-earth element selected from the group consisting of Pr, Nd, Dy and Tb; M is at least one element selected from the group consisting of Al, Si, Ti, V, Cr, Mn, Cu, Zn, Ga, Zr, Nb, Mo, Ag, Hf, Ta, W, Pt, Au and Pb and always includes Ti; and the mole fractions x, y, z and m satisfy the inequalities of: 10 at %<x≦20 at %; 6 at %<y<10 at %; 0.1 at %≦z≦12 at %; and 0≦m≦0.5, respectively.

15. The method of claim 12, wherein the step (a) includes the steps of:

cooling a melt of the first iron-based rare-earth alloy by a melt-quenching process, thereby forming a rapidly solidified alloy with a thickness of 70 μm to 300 μm; and pulverizing the rapidly solidified alloy.

16. The method of claim 15, further comprising the step of thermally treating and crystallizing the rapidly solidified alloy before the step of pulverizing is performed.

17. The method of claim 15, wherein the step of pulverizing is carried out with a pin mill machine or a hammer mill machine.

18. The method of claim 15, wherein the rapidly solidified alloy includes at least one metastable phase, which is selected from the group consisting of $Fe_{23}B_6$, $Fe_3B$, $R_2Fe_{14}B$ and $R_2Fe_{23}B$ phases, and/or an amorphous phase.

19. The method of claim 15, wherein the step of cooling includes the step of bringing the melt into contact with a roller, which is rotating at a roller surface peripheral velocity of 1 m/s to 13 m/s, thereby forming the rapidly solidified alloy.

20. The method of claim 19, wherein the step of cooling is carried out within a reduced-pressure atmosphere.

21. The method of claim 20, wherein the reduced-pressure atmosphere has an absolute pressure of 1.3 kPa to 90 kPa.

22. The method of claim 12, wherein the second iron-based rare-earth alloy powder has a composition represented by the general formula:

$$Fe_{100-x-y}Q_xR_y$$

where Fe is iron; Q is at least one element selected from the group consisting of B and C and always includes B; R is at least one rare-earth element selected from the group consisting of Pr, Nd, Dy and Tb; and the mole fractions x and y satisfy the inequalities of 1 at %≦x≦6 at % and 10 at %≦y≦25 at %, respectively.

23. A method of making a compound for use to make a magnet, the method comprising the steps of:

preparing the iron-based rare-earth alloy powder by the method of claim 12; and mixing the iron-based rare-earth alloy powder and a resin together.

24. The method of claim 23, wherein the resin is a thermoplastic resin.

25. A method for producing a permanent magnet comprising the step of injection-molding the compound made by the method of claim 24.

26. A method for fabricating a motor, comprising the steps of:

preparing a rotor, which has a magnet slot in its iron core;

injection-molding the compound for use to make a magnet, made by the method of claim 24, in the magnet slot; and providing a stator surrounds the rotor.

* * * * *